US010649358B2

(12) United States Patent
Ebe

(10) Patent No.: US 10,649,358 B2
(45) Date of Patent: May 12, 2020

(54) IMAGE FORMING APPARATUS

(71) Applicant: Oki Data Corporation, Tokyo (JP)

(72) Inventor: Takaaki Ebe, Tokyo (JP)

(73) Assignee: Oki Data Corporation, Tokyo (JP)

( * ) Notice: Subject to any disclaimer, the term of this patent is extended or adjusted under 35 U.S.C. 154(b) by 156 days.

(21) Appl. No.: 15/903,013

(22) Filed: Feb. 22, 2018

(65) Prior Publication Data

US 2018/0246435 A1 Aug. 30, 2018

(30) Foreign Application Priority Data

Feb. 27, 2017 (JP) ..... 2017-035423

(51) Int. Cl.
*G03G 15/00* (2006.01)
*G03G 21/00* (2006.01)
(Continued)

(52) U.S. Cl.
CPC ..... *G03G 13/16* (2013.01); *G03G 13/01* (2013.01); *G03G 13/20* (2013.01); *G03G 15/168* (2013.01); *G03G 15/1615* (2013.01); *G03G 15/6564* (2013.01); *G03G 15/6585* (2013.01); *G03G 15/5008* (2013.01); *G03G 2215/00945* (2013.01); *G03G 2215/00949* (2013.01); *G03G 2215/16* (2013.01)

(58) Field of Classification Search
CPC ..... G03G 15/00; G03G 15/01; G03G 15/08; G03G 15/14–15/20; G03G 13/00; G03G 13/01; G03G 13/08; G03G 13/14–13/20; G03G 2215/16; G03G 21/00; G03G 15/1615; G03G 15/168; G03G 15/5008; G03G 15/6564; G03G 15/6585; G03G 2215/00945; G03G 2215/00949
See application file for complete search history.

(56) References Cited

U.S. PATENT DOCUMENTS 8,639,136 B2 * 1/2014 Tomura ..... G03G 15/0189 399/396
2004/0126125 A1 * 7/2004 Yoda ..... G03G 15/1625 399/45

(Continued)

FOREIGN PATENT DOCUMENTS

EP 2071408 A2 6/2009
JP 2006-078883 A 3/2006

*Primary Examiner* — Nguyen Q. Ha
(74) *Attorney, Agent, or Firm* — Rabin & Berdo, P.C.

(57) ABSTRACT

An image forming apparatus includes a toner image supporting section and a medium transfer section. The toner image supporting section includes first and second toner image supporting member that support first and second toner images at first and second linear speeds, respectively. The medium transfer section transfers, onto a medium, the first and second toner images respectively supported by the first and second toner image supporting members, to thereby cause the first and second toner images to be superimposed on each other. The following conditional expression (1) is satisfied when the medium transfer section transfers the first and second toner images onto the medium, $$(Vd1-Vt1)/(Vt1>(Vd2-Vt2)/Vt2 \quad (1)$$

where Vd1 is the first linear speed, Vt1 is a first conveyance speed of the medium, Vd2 is the second linear speed, and Vt2 is a second conveyance speed of the medium.

14 Claims, 8 Drawing Sheets

(51) Int. Cl.

| | |
|---|---|
| ***G03G 13/16*** | (2006.01) |
| ***G03G 15/16*** | (2006.01) |
| ***G03G 13/01*** | (2006.01) |
| ***G03G 13/20*** | (2006.01) |

(56) References Cited

U.S. PATENT DOCUMENTS

| | | | | |
|---|---|---|---|---|
| 2012/0051816 | A1 | 3/2012 | Chiyoda | |
| 2012/0229819 | A1* | 9/2012 | Koyatsu | G03G 15/0126 358/1.1 |
| 2013/0195487 | A1 | 8/2013 | Yamashita et al. | |
| 2015/0029518 | A1* | 1/2015 | Tashiro | G03G 15/01 358/1.1 |
| 2015/0309440 | A1 | 10/2015 | Ishii | |
| 2016/0091816 | A1* | 3/2016 | Kochi | G03G 15/0131 399/66 |

* cited by examiner

IMAGE FORMING APPARATUS

CROSS REFERENCE TO RELATED APPLICATIONS

The present application claims priority from Japanese Patent Application No. 2017-035423 filed on Feb. 27, 2017, the entire contents of which are hereby incorporated by reference.

BACKGROUND

The technology relates to an image forming apparatus that forms a toner image on a medium.

In general, when an image forming apparatus of an electrophotography scheme forms an image on a medium having relatively-great surface roughness, it may be difficult to fill a concave part of the medium with a developer in some cases. This may lead to degradation of image quality. To address this, a technique has been proposed that forms a colored toner image after forming an image such as a white toner image or a transparent toner image on a surface of the medium, for example, as disclosed in Japanese Unexamined Patent Application Publication No. 2006-78883.

SUMMARY

It is desired to form an image having higher quality even on a medium having further greater surface roughness.

It is desirable to provide an image forming apparatus that is able to form an image having higher quality on a medium having a surface with large irregularities.

According to one embodiment of the technology, there is provided an image forming apparatus. The image forming apparatus includes: a toner image supporting section that includes a first toner image supporting member supporting a first toner image at a first linear speed and a second toner image supporting member supporting a second toner image at a second linear speed; and a medium transfer section that transfers, onto a medium, the first toner image supported by the first toner image supporting member and the second toner image supported by the second toner image supporting member. Or, the image forming apparatus includes: a toner image supporting section that includes a toner image supporting member supporting a first toner image at a first linear speed and supporting a second toner image at a second linear speed; and a medium transfer section that transfers, onto a medium, the first toner image and the second toner image both supported by the toner image supporting section. The medium transfer section transfers the first toner image and the second toner image onto the medium to thereby cause the first toner image and the second toner image to be superimposed on each other. The following conditional expression (1) is satisfied when the medium transfer section transfers the first toner image and the second toner image onto the medium to thereby cause the first toner image and the second toner image to be superimposed on each other, $$(Vd1-Vt1)/Vt1>(Vd2-Vt2)/Vt2 \quad (1)$$

where Vd1 is the first linear speed, Vt1 is a first conveyance speed of the medium at time when the first toner image is transferred, Vd2 is the second linear speed, and Vt2 is a second conveyance speed of the medium at time when the second toner image is transferred.

According to one embodiment of the technology, there is provided an image forming apparatus that includes a toner image supporting section and a medium transfer section. The toner image supporting section performs a first image forming operation and a second image forming operation. The first image forming operation forms a first toner image at a first linear speed. The first toner image is one of a first transparent image and a white image. The second image forming operation sequentially forms a second toner image and a third toner image each at a second linear speed, after the first image forming operation. The second toner image is a second transparent image. The third toner image is a colored image. The medium transfer section performs a first transfer operation and a second transfer operation. The first transfer operation transfers the first toner image onto a medium conveyed at a first conveyance speed before the second image forming operation. The second transfer operation transfers the third toner image and the second toner image to thereby cause the third toner image and the second toner image to be stacked in order on the first toner image transferred onto the medium conveyed at a second conveyance speed. The following conditional expression (1) and the following conditional expression (2) are satisfied, $$(Vd1-Vt1)/Vt1>(Vd2-Vt2)/Vt2 \quad (1)$$

$$Vd1>Vt1 \quad (2)$$

where Vd1 is the first linear speed, Vt1 is the first conveyance speed, Vd2 is the second linear speed, and Vt2 is the second conveyance speed.

DETAILED DESCRIPTION

Some example embodiments of the technology are described below in detail with reference to the accompanying drawings. It is to be noted that the description below refers to mere specific examples of the technology, and the technology is therefore not limited thereto. Further, the technology is not limited to factors such as arrangements, dimensions, and dimension ratios of components illustrated in the respective drawings. The elements in the following example embodiments which are not recited in a most-generic independent claim of the technology are optional and may be provided on an as-needed basis. The description is given in the following order.

1. First Example Embodiment (An example of an image forming apparatus that transfers a transparent image formed at a first linear speed onto a medium conveyed at a first conveyance speed, and thereafter, so transfers a colored image formed at a second linear speed onto the medium that the colored image is superimposed on the transparent image on the medium conveyed at a second conveyance speed)

2. Second Example Embodiment (An example of an image forming apparatus that transfers a first transparent image onto a medium, and thereafter, further so transfers a colored image and a second transparent image onto the medium that the colored image and the second transparent image are superimposed on the first transparent image)

3. Experiment Examples

4. Modification Examples

1. FIRST EXAMPLE EMBODIMENT

[1-1. Configuration of Image Forming Apparatus 1]

Figure 1:
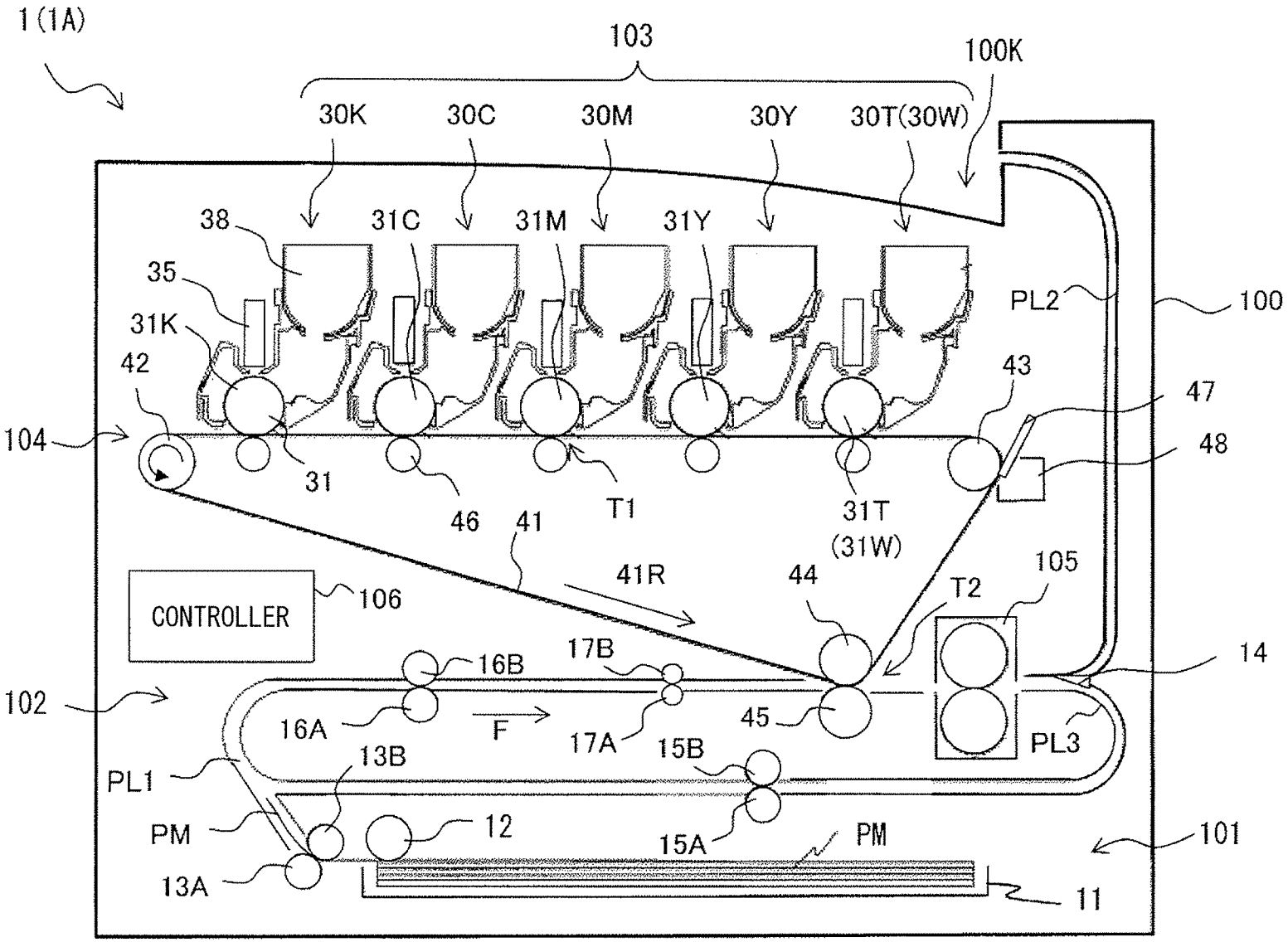
FIG. 1 is a schematic diagram illustrating an example of a general configuration of an image forming apparatus according to a first example embodiment of the technology.
Figure 2:
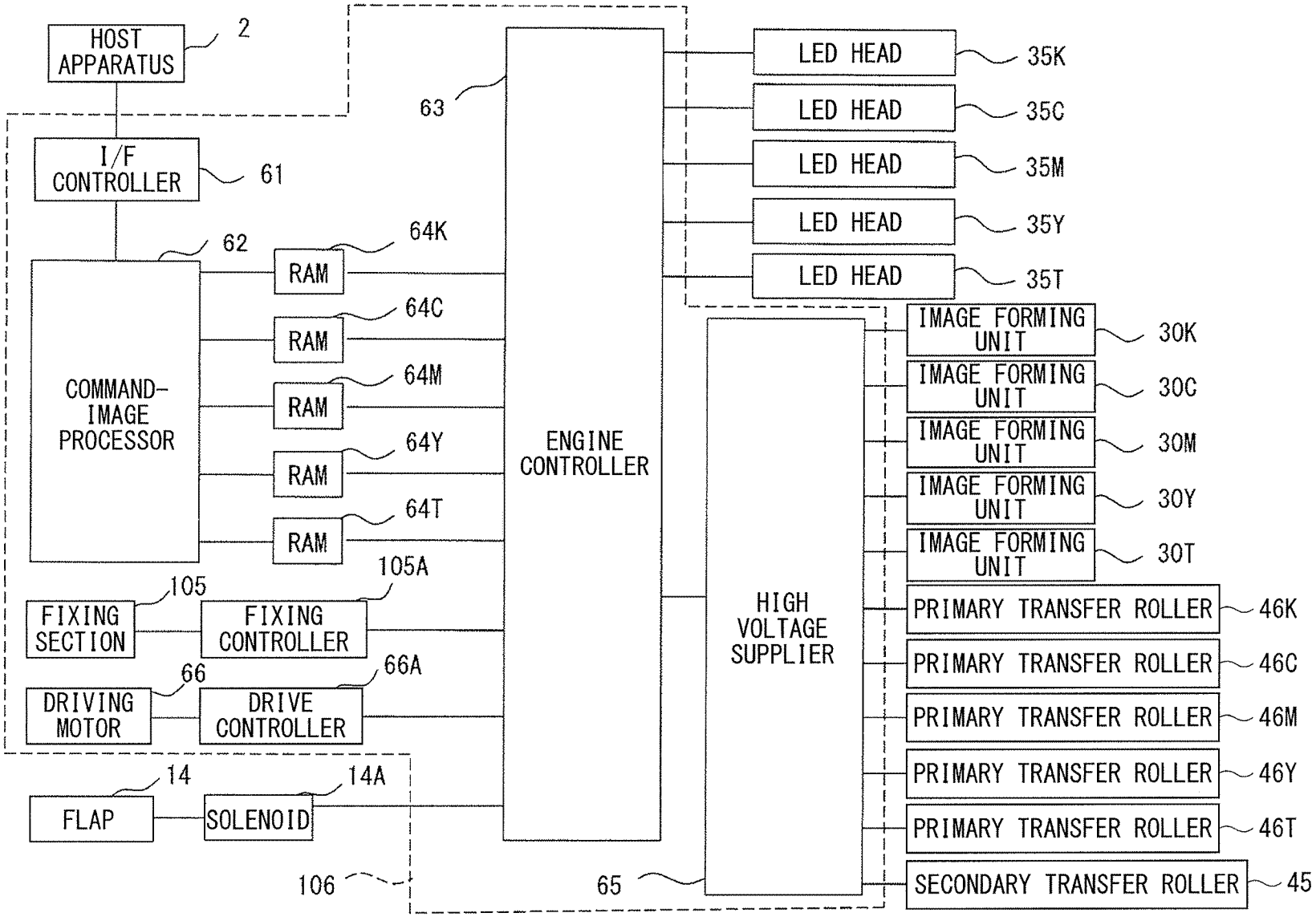
FIG. 2 is a block diagram schematically illustrating an example of an internal configuration of the image forming apparatus illustrated in FIG. 1.

FIG. 1 schematically illustrates an example of a general configuration of an image forming apparatus 1 according to a first example embodiment of the technology. FIG. 2 is a block diagram illustrating an example of a configuration of a control mechanism of the image forming apparatus 1. The image forming apparatus 1 may correspond to an "image forming apparatus" in one specific but non-limiting embodiment of the technology. The image forming apparatus 1 may be a printer that forms, using an electrophotography scheme, an image such as a color image on a medium PM such as a sheet or a film that is to be subjected to printing, for example. Non-limiting examples of the medium PM may include a sheet having relatively-high heat resistance such as plain paper and a resin film. Non-limiting examples of the resin film may include a polyethylene (PE) film, a polypropylene (PP) film, a polyvinyl chloride (PVC) film, and a polyethylene terephthalate (PET) film.

Referring to FIG. 1, the image forming apparatus 1 may include, for example, inside a housing 100, a medium feeding section 101, a medium conveying section 102, an image forming section 103, a transfer section 104, a fixing section 105, and a controller 106. A placement tray 100K may be provided outside the housing 100. The placement tray 100K may be a tray on which the medium PM formed with an image is to be placed. In the image forming apparatus 1, the medium PM may be conveyed along conveyance paths PL1 to PL3 illustrated in FIG. 1 from the medium feeding section 101 toward the placement tray 100K. The conveyance path PL1 may be branched into the conveyance path PL2 and the conveyance path PL3. The conveyance path PL2 may extend on downstream side of the fixing section 105 toward the placement tray 100K. The conveyance path PL3 may join the conveyance path PL1 again between a pair of conveying rollers 13A and 13B and a pair of conveying rollers 16A and 16B which are all described later. It is to be noted that, herein, regarding the conveyance paths PL1 to PL3, a direction from any point toward the medium feeding section 101 or a position that is closer to the medium feeding section 101 than any point is referred to as "upstream" of the point. A direction from any point toward the placement tray 100K or a position that is closer to the placement tray 100K than any point is referred to as "downstream" of the point. The image forming apparatus 1 may further include a flap 14, a solenoid 14A, and a driving motor 66 illustrated in FIG. 2. The solenoid 14A may drive the flap 14.

[Medium Feeding Section 101]

The medium feeding section 101 may include a medium cassette (medium feeding tray) 11 and a medium feeding roller 12, for example. The medium cassette 11 may contain a plurality of media PM in a stacked manner. The medium feeding roller 12 may pick up the media PM one by one from the medium cassette 11, and sequentially feed the media PM picked up to the medium conveying section 102 one by one. The medium feeding roller 12 may be rotated by the driving motor 66 on the basis of an instruction given by an engine controller 63 of the controller 106 illustrated in FIG. 2. The driving motor 66 may be controlled by a drive controller 66A illustrated in FIG. 2.

[Medium Conveying Section 102]

The medium conveying section 102 may include the pair of conveying rollers 13A and 13B, the pair of conveying rollers 16A and 16B, and a pair of conveying rollers 17A and 17B, for example, in order from the upstream along the conveyance path PL1. In one example, the medium conveying section 102 may further include a position sensor that detects a position of the medium PM that travels forward along the conveyance path PL1. The pair of conveying rollers 13A and 13B, the pair of conveying rollers 16A and 16B, and the pair of conveying rollers 17A and 17B may convey the medium PM fed from the medium feeding roller 12 toward a secondary transfer section T2 that is located downstream of the pair of conveying rollers 13A and 13B, the pair of conveying rollers 16A and 16B, and the pair of conveying rollers 17A and 17B. The secondary transfer section T2 will be described later in greater detail. As with the medium feeding roller 12, the pair of conveying rollers 13A and 13B, the pair of conveying rollers 16A and 16B, and the pair of conveying rollers 17A and 17B may be rotated by the driving motor 66 on the basis of an instruction given by the engine controller 63. The driving motor 66 may be controlled by the drive controller 66A. The medium conveying section 102 may further include a pair of conveying rollers 15A and 15B provided along the conveyance path PL3.

[Image Forming Section 103]

The image forming section 103 may form a toner image (a developer image). The image forming section 103 may include five image forming units, i.e., image forming units 30T, 30Y, 30M, 30C, and 30K, for example. The image forming units 30T, 30Y, 30M 30C, and 30K may basically have respective configurations that are the same as each other except that the image forming units 30T, 30Y, 30M, 30C, and 30K may form respective toner images by the use of toners TN illustrated in FIG. 3 having respective colors that are different from each other. Hereinafter, the image forming units 30T, 30Y, 30M, 30C, and 30K may be collectively referred to as an image forming unit 30 when the image forming units 30T, 30Y, 30M, 30C, and 30K are not distinguished from each other in particular. In one example, the image forming unit 30T may form a transparent toner image by the use of a transparent (T) toner. The image forming unit 30Y may form a yellow toner image by the use of a yellow (Y) toner. The image forming unit 30M may form a magenta toner image by the use of a magenta (M) toner. The image forming unit 30C may form a cyan toner image by the use of a cyan (C) toner. The image forming unit 30K may form a black toner image by the use of a black (K) toner. In this example, the transparent toner image may correspond to any of a "first toner image", a "first transparent image", and a "second transparent image" in respective specific but non-limiting embodiments of the technology. In contrast, each of the yellow toner image, the magenta toner image, the cyan toner image, and the black toner image may correspond to any of a "second toner image" and a "colored image" in respective specific but non-limiting embodiments of the technology. It is to be noted that, when the medium PM is white, the image forming section 103 may include, instead of the image forming unit 30T, an image forming unit 30W that forms a white toner image by the use of a white (W) toner. The white toner image may correspond to any of the "first toner image" and a "white image" in respective specific but non-limiting embodiments of the technology. Alternatively, when the medium PM is of another color, i.e., a color other than white, the image forming section may include, instead of the image forming unit 30T, an image forming unit that forms a toner image of a color that is the same as the color of the medium PM.

Each of the foregoing toners may include agents such as a predetermined coloring agent, a predetermined release agent, a predetermined electric charge control agent, and a predetermined treatment agent, for example. Components of the respective agents described above may be mixed as appropriate or subjected to a surface treatment. Each of the toners may be thus manufactured. The coloring agent, the release agent, and the electric charge control agent of the foregoing agents may serve as internal additives. Further, in one example embodiment, each of the toners may include an external additive such as silica and titanium oxide, and binding resin such as polyester resin.

As the coloring agent used for each of the yellow toner, the magenta toner, the cyan toner, and the black toner, an agent such as a dye and a pigment may be used solely, or a plurality of agents such as the dye and the pigment may be used in any combination. Specific but non-limiting examples of such a coloring agent may include carbon black, an iron oxide, permanent brown FG, pigment green B, pigment blue 15:3, solvent blue 35, solvent red 49, solvent red 146, quinacridone, carmine 6B, naphtol, disazo yellow, and isoindoline. Specific but non-limiting coloring agent used for the white toner may include a titanium oxide and a calcium carbonate. It is to be noted that the transparent toner may not include any coloring agent such as a pigment, and may become colorless and transparent after the transparent toner is fixed.

The image forming unit 30T that forms the transparent toner image or the image forming unit 30W that forms the white toner image may be provided at the most upstream position of the positions of the respective image forming units 30T or 30W, 30Y, 30M, 30C, and 30K. The image forming unit 30Y, the image forming unit 30M, the image forming unit 30C, and the image forming unit 30K may be disposed in order from the upstream toward the downstream, at positions that are located downstream of the image forming unit 30T or 30W. The image forming unit 30T or 30W may correspond to a "first image forming unit" in one specific but non-limiting embodiment of the technology. Each of the image forming units 30Y, 30M, 30C, and 30K may correspond to a "second image forming unit" in one specific but non-limiting embodiment of the technology.

Figure 3:
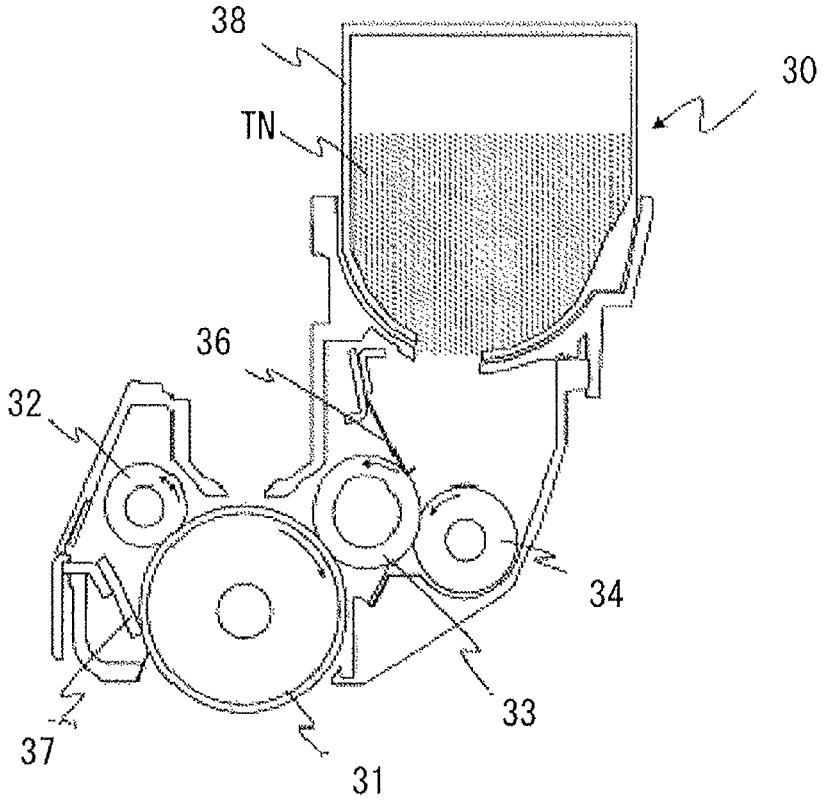
FIG. 3 is a schematic diagram illustrating a main part of an image forming unit illustrated in FIG. 1.

FIG. 3 is a schematic diagram illustrating, in an enlarged manner, an example of a configuration of each of the image forming units 30. Each of the image forming units 30 may include a photosensitive drum 31, a charging roller 32, a developing roller 33, a feeding roller 34, a light-emitting diode (LED) head 35 illustrated in FIG. 1, a doctor blade 36, a cleaning blade 37, and a toner tank 38, for example.

The photosensitive drum 31 may have a substantially-cylindrical appearance and has a surface (a surficial part) supporting an electrostatic latent image. The photosensitive drum 31 may include a photoreceptor such as an organic photoreceptor. In one example, the photosensitive drum 31 may include an electrically-conductive supporting body and a photoconductive layer that covers an outer circumferential part (a surface) of the electrically-conductive supporting body, for example. The electrically-conductive supporting body may include a metal pipe including aluminum, for example. The photoconductive layer may have a structure including an electric charge generation layer and an electric charge transfer layer that are stacked in order, for example. The foregoing photosensitive drum 31 may be caused to rotate at a predetermined circumferential velocity by the driving motor 66 illustrated in FIG. 2. In the example illustrated in FIGS. 1 and 3, the photosensitive drum 31 may rotate clockwise. As illustrated in FIG. 2, the driving motor 66 may be controlled by the drive controller 66A on the basis of the instruction given by the engine controller 63.

The charging roller 32 may have a substantially-columnar appearance and electrically charge the surface (the surficial part) of the photosensitive drum 31. The charging roller 32 may be so disposed that a circumferential surface of the charging roller 32 is in contact with a surface (a circumferential surface) of the photosensitive drum 31. The charging roller 32 may include a metal shaft and an electrically-semiconductive rubber layer that covers an outer circumferential part (a surface) of the metal shaft, for example. Non-limiting examples of the electrically-semiconductive rubber layer may include an electrically-semiconductive epichlorohydrin rubber layer. It is to be noted that, in the example illustrated in FIG. 3, the charging roller 32 may rotate anticlockwise, i.e., in a direction opposite to a rotation direction of the photosensitive drum 31. Further, a charging voltage of the charging roller 32 may be applied by a high voltage supplier 65 on the basis of an instruction given by the engine controller 63, as illustrated in FIG. 2.

The developing roller 33 may have a substantially-columnar appearance and have a surface supporting the toner TN that develops the electrostatic latent image. The developing roller 33 may be so disposed as to be in contact with the surface (the circumferential surface) of the photosensitive drum 31. The developing roller 33 may include a metal shaft and an electrically-semiconductive urethane rubber layer that covers an outer circumferential part (a surface) of the metal shaft, for example. The developing roller 33 may rotate at a predetermined circumferential velocity. In the example illustrated in FIG. 3, the developing roller 33 may rotate anticlockwise, i.e., in a direction opposite to the rotation direction of the photosensitive drum 31. Further, a development voltage of the developing roller 33 may be applied by the high voltage supplier 65 on the basis of an instruction given by the engine controller 63, as illustrated in FIG. 2.

The feeding roller 34 may have a substantially-columnar appearance and feed the toner TN to the developing roller 33. The feeding roller 34 may be so disposed as to be in contact with a surface (a circumferential surface) of the developing roller 33. The feeding roller 34 may include a metal shaft and a foamed silicone rubber layer that covers an outer circumferential part (a surface) of the metal shaft, for example. It is to be noted that, in the example illustrated in FIG. 3, the feeding roller 34 may rotate anticlockwise, i.e., in a direction same as a rotation direction of the developing roller 33.

The LED head 35 may perform exposure on the surface (the surficial part) of the photosensitive drum 31, and thereby form an electrostatic latent image on the surface (the surficial part) of the photosensitive drum 31. The LED head 35 may include a light source that emits application light, and a lens array that performs imaging of the application light on the surface (the surficial part) of the photosensitive drum 31, for example. The light source that emits the application light may be a light-emitting diode, for example. Further, an operation of the LED head 35 may be controlled by the engine controller 63, as illustrated in FIG. 2.

The doctor blade 36 may control an amount of the toner TN attached to the surface of the developing roller 33.

The cleaning blade 37 may be a cleaning member that scrapes and collects the toner remained on the surface (the surficial part) of the photosensitive drum 31 to thereby clean the surface of the photosensitive drum 31. The cleaning blade 37 may be so disposed as to be in contact with the surface of the photosensitive drum 31 in a counter direction. In other words, the cleaning blade 37 may be so disposed as to protrude in a direction opposite to the rotation direction of the photosensitive drum 31. The cleaning blade 37 may include an elastic member such as polyurethane rubber, for example.

The toner tank 38 may be a container that contains the toner TN, and have a toner discharging opening at a lower part of the toner tank 38.

[Transfer Section 104]

The transfer section 104 may transfer, onto the medium PM, the toner image formed in the image forming section 103. The transfer section 104 may include an intermediate transfer belt 41, a driving roller 42, a driven roller 43, a backup roller 44, a secondary transfer roller 45, a plurality of primary transfer rollers 46, a cleaning blade 47, and a waste toner container 48, for example.

The intermediate transfer belt 41 may be an endless elastic belt including a base member, an elastic layer provided on a surface of the base member, and a coating layer that covers the elastic layer, for example. The base member may include a material such as a resin material. The elastic layer may include a material such as urethane rubber. In one example embodiment, the base member of the intermediate transfer belt 41 may allow deformation of the base member upon circular rotation which will be described later to fall within a certain range. For example, in one example embodiment, the base member of the intermediate transfer belt 41 may have a Young's modulus of about 2000 Mpa or greater. In another example embodiment, the base member of the intermediate transfer belt 41 may have a Young's modulus of about 3000 Mpa or greater. Specific but non-limiting examples of the constituent material of the base member of the intermediate transfer belt 41 may include resin such as polyimide (PI), polyamideimide (PAI), polyetherimide (PEI), polyphenylenesulfide (PPS), polyetheretherketone (PEEK), polyvinylidenedifluoride (PVDF), polyamide (PA), polycarbonate (PC), and polybutylene terephthalate (PBT). It is to be noted that any of the foregoing resin materials may be used solely, or any of the foregoing resin materials may be used in mixture. Further, in one example embodiment, carbon black may be added to the base member as an electrically-conducting agent. As the carbon black, any of materials such as furnace black, channel black, Ketjen black, or acetylene black may be used solely, or any of the foregoing materials may be used in mixture. In one example embodiment, the furnace black, the channel black, or both may be used to obtain a predetermined resistance. Depending on the use of the carbon black, carbon black subjected to an oxidation degradation prevention treatment such as an oxidation treatment or a graft treatment or carbon black with improved dispersibility to a solvent may be used. In one example of the present example embodiment, the content of the carbon black in the base member may be from about 3 wt % to about 40 wt % both inclusive in terms of securing of mechanical strength. In another example of the present example embodiment, the content of the carbon black in the base member may be from about 3 wt % to about 30 wt % both inclusive in terms of securing of mechanical strength. It is to be noted that a method of providing electric conductivity is not limited to an electronic conducting method utilizing a material such as carbon black. Alternatively, an ion conducting agent may be added. Further, the material of the elastic layer is not limited to urethane rubber. Alternatively, the elastic layer may include an elastic body such as chloroprene rubber, silicone rubber, or butadiene rubber. When the elastic layer includes the elastic body such as chloroprene rubber, silicone rubber, or butadiene rubber, the elastic body may have rubber hardness of Shore 70A or lower in one example embodiment, and may have rubber hardness of Shore 60A or lower in another example embodiment, in terms of improvement in adherence to the medium PM. In the first example embodiment, the elastic layer may be provided with electric conductivity by adding the ion conducting agent to urethane rubber. Carbon black may be added to the elastic layer as with the base member; however, the addition of the carbon black may possibly increase the rubber hardness of the urethane rubber in some cases. In contrast, when the ion conducting agent is added to the elastic layer, such an increase in rubber hardness is suppressed, and an effect of reducing variations in electric resistance value in the intermediate transfer belt 41 as a whole may be also expectable. In one example embodiment, the coating layer may include urethane having low hardness ($E_IT \leq 3$ GPa) to avoid loss of elasticity of the elastic layer. In one example embodiment, the coating layer may have high releasing properties for the toner image upon the secondary transfer or upon cleaning. Accordingly, for example, a water repellent agent containing fluorine may be added to the urethane resin. The surface energy of the coating layer may be thereby decreased. The foregoing intermediate transfer belt 41 may lie on the driving roller 42, the driven roller 43, and the backup roller 44, while being stretched. It is to be noted that the intermediate transfer belt 41 may correspond to any of a "first toner image supporting member", a "second toner image supporting member", and an "intermediate transfer member" in respective specific but non-limiting embodiments of the technology.

The driving roller 42 may be caused to rotate anticlockwise in a direction indicated by an arrow illustrated in FIG. 1 by driving force transmitted from the driving motor 66 illustrated in FIG. 2. Further, the driving roller 42 may cause the intermediate transfer belt 41 to rotate circularly in a direction indicated by an arrow 41R illustrated in FIG. 1. The driving roller 42 may be located downstream of the image forming units 30T, 30Y, 30M, 30C, and 30K in a direction in which the intermediate transfer belt 41 is to be conveyed. The driven roller 43 may be rotated in accordance with the rotation of the driving roller 42.

Each of the plurality of primary transfer rollers 46 may electrostatically transfer, onto the intermediate transfer belt 41, the toner image formed in corresponding one of the image forming units 30T, 30Y, 30M, 30C, and 30K. Each of the primary transfer rollers 46 may be disposed at a position corresponding to corresponding one of the image forming units 30T, 30Y, 30M, 30C, and 30K with the intermediate transfer belt 41 in between. The primary transfer rollers 46 may configure a primary transfer section T1 together with the photosensitive drums 31 facing the primary transfer rollers 46. Each of the primary transfer rollers 46 may include a material such as a foamed electrically-semiconductive elastic rubber material. Further, each of the primary transfer rollers 46 may receive a predetermined transfer voltage from the high voltage supplier 65 illustrated in FIG. 2. The transfer voltage to be applied to each of the primary transfer rollers 46 may be controlled by the engine controller 63 as illustrated in FIG. 2, for example.

The secondary transfer roller 45 and the backup roller 44 may face each other and sandwich the intermediate transfer belt 41 in between. The backup roller 44 and the secondary transfer roller 45 may configure a secondary transfer section T2 that transfers, onto the medium PM, the toner image on the surface of the intermediate transfer belt 41. The secondary transfer roller 45 may include a metal core member and an elastic layer that is wound around an outer circumferential surface of the core member, for example. The elastic layer may be a foamed rubber layer, for example. The secondary transfer roller 45 may be biased toward the backup roller 44. The secondary transfer roller 45 may be thereby pressed against the backup roller 44 with the intermediate transfer belt 41 in between. A predetermined transfer pressure may be thereby applied to the medium PM that passes through the secondary transfer section T2.

The backup roller 44 and the secondary transfer roller 45 may transfer, onto the medium PM fed from the pair of conveying rollers 22, the toner image on the surface of the intermediate transfer belt 41. In other words, the backup roller 44 and the secondary transfer roller 45 may perform secondary transfer. Upon the secondary transfer, the secondary transfer roller 45 may receive a transfer bias (a direct-current voltage). This may provide a potential difference between the secondary transfer roller 45 and the backup roller 44, which causes the toner image to be transferred onto the medium PM. The secondary transfer roller 45 may receive a predetermined transfer voltage from the high voltage supplier 65 illustrated in FIG. 2. The transfer voltage to be applied to the secondary transfer roller 45 may be controlled by the engine controller 63, as illustrated in FIG. 2, for example.

When the image forming apparatus 1 forms only the transparent toner image by the image forming unit 30T without forming any colored toner image (the yellow toner image, the magenta toner image, the cyan toner image, and the black toner image), the primary transfer roller 46 in each of the image forming units 30Y, 30M, 30C, and 30K that form the colored toner image may be moved to a position away from the intermediate transfer belt 41, in one example. One reason for this is that this avoids damage on the transparent toner image formed on the intermediate transfer belt 41.

The cleaning blade 47 may scrape the toner TN remained on the intermediate transfer belt 41 without being subjected to the second transfer onto the medium PM. The cleaning blade 47 may be a cleaning member that cleans the surface of the intermediate transfer belt 41. The cleaning blade 47 may be so disposed as to be in contact with the surface of the intermediate transfer belt 41 in a counter direction. In other words, the cleaning blade 47 may be so disposed as to protrude in a direction opposite to the rotation direction of the intermediate transfer belt 41. The waste toner container 48 may contain the waste toner scraped by the cleaning blade 47.

[Fixing Section 105]

Figure 4:
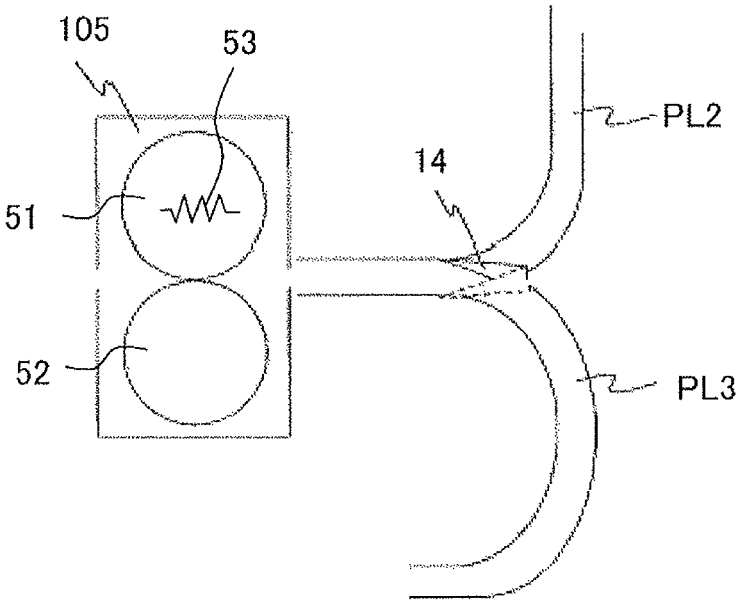
FIG. 4 is a schematic diagram illustrating a fixing section and a flap illustrated in FIG. 1.

The fixing section 105 may apply heat and pressure to the toner image transferred onto the medium PM conveyed from the transfer section 104, and thereby fix the toner image onto the medium PM. The fixing section 105 may include a fixing roller 51 and a pressure-applying roller 52 as illustrated in FIG. 4, for example. The fixing roller 51 may include a heater 53 that is built in the fixing roller 51. FIG. 4 is an outline diagram illustrating the fixing section 105 and the vicinity of the fixing section 105 in an enlarged manner. The fixing section 105 may be controlled by a fixing controller 105A on the basis of an instruction given by the engine controller 63, for example. Further, the fixing section 105 may be so configured that a predetermined current is fed to the heater 53 built in the fixing roller 51, for example. Further, the pressure-applying roller 52 may be biased toward the fixing roller 51. The pressure-applying roller 52 may be thereby pressed against the fixing roller 51. This may apply a predetermined fixing pressure, i.e., a nip pressure, to the medium PM that passes through the fixing section 105.

As described above, the conveyance path PL1 may be branched into the conveyance path PL2 and the conveyance path PL3 on the downstream side of the fixing section 105. The conveyance path PL2 may be directed to discharging of the medium PM to the placement tray 100K located outside of the housing 100. The conveyance path PL3 may serve as a returning path that causes the medium PM to return again to the conveyance path PL1. A branch part at which the conveyance path PL1 is branched into the conveyance path PL2 and the conveyance path PL3 may be provided with the flap 14. The flap 14 may be so moved that one of a position illustrated by a solid line and a position illustrated by a dashed line in FIG. 4 is selected thereby, for example. The flap 14 may thus guide the medium PM that has passed through the fixing section 105 along the conveyance path PL1 to enter one of the conveyance path PL2 and the conveyance path PL3.

The flap 14 may block the conveyance path PL3 when the flap 14 guides the medium PM into the conveyance path PL2. The flap 14 may block the conveyance path PL2 when the flap 14 guides the medium PM into the conveyance path PL3. The flap 14 may be caused to operate by the solenoid 14A on the basis of an instruction given by the engine controller 63, for example.

In one example, the image forming apparatus 1 may further include a pair of conveying rollers directed to discharging, toward the placement tray 100K provided outside, of the medium PM that has been discharged from the fixing section 105. Such a pair of conveying rollers directed to discharging of the medium PM may be provided downstream of the branch part at which the conveyance path PL1 is branched into the conveyance path PL2 and the conveyance path PL3, for example.

It is to be noted that the image forming section 103 and the transfer section 104 including the intermediate transfer belt 41, the primary transfer rollers 46, the driving roller 42, and the driven roller 43, of the image forming apparatus 1 illustrated in FIG. 1 may correspond together to a "toner image supporting member" in one specific but non-limiting embodiment of the technology. The "toner image supporting member" in one specific but non-limiting embodiment of the technology may support a toner image to be transferred on to a medium. Further, the photosensitive drum 31T or 31W and the intermediate transfer belt 41 may correspond together to a "first toner image supporting member" in one specific but non-limiting embodiment of the technology. The photosensitive drums 31K, 31C, 31M, and 31Y and the intermediate transfer belt 41 may correspond together to a "second toner image supporting member" in one specific but non-limiting embodiment of the technology. Further, the secondary transfer roller 45 may correspond to a "medium transfer section" in one specific but non-limiting embodiment of the technology. The secondary transfer roller 45 may be a component directed to moving of the toner image on the intermediate transfer belt 41 relative to the medium PM. It is to be noted that the "toner image supporting member" in one specific but non-limiting embodiment of the technology is not limited to that including all of the components of the image forming section 103 and all of the components of the transfer section 104 illustrated in FIG. 1. Further, the "toner image supporting member" in one specific but non-limiting embodiment of the technology may include any component other than the components of the image forming section 103 and the components of the transfer section 104. Similarly, the "medium transfer section" in one specific but non-limiting embodiment of the technology may include any component other than the secondary transfer roller 45 illustrated in FIG. 1.

[1-2. Configuration of Control Mechanism, etc.]

Referring to FIGS. 1 and 2, a description is given below of a control mechanism of the image forming apparatus 1 according to the first example embodiment. As illustrated in FIG. 2, the controller 106 may include an interface (I/F) controller 61, a command-image processor 62, the engine controller 63, random access memories (RAMs) 64, i.e., RAMs 64T, 64Y, 64M, 64C, and 64K, the high voltage supplier 65, the drive controller 66A, and the fixing controller 105A, for example.

The engine controller 63 may include, for example, a microprocessor, an input-output port, etc. The engine controller 63 may perform a control of a process operation of the image forming apparatus 1 as a whole, for example, by executing a predetermined program. For example, the engine controller 63 may receive print data, a control command, etc. from the I/F controller 61 via the command-image processor 62. Further, the engine controller 63 may cause a printing operation to be performed by performing a general control of the LED heads 35, i.e., the LED heads 35T, 35Y, 35M, 35C, and 35K, the high voltage supplier 65, the drive controller 66A, the solenoid 14A, and the fixing controller 105A that are coupled to the engine controller 63, and any other unit that is coupled to the engine controller 63.

The I/F controller 61 may receive, for example, image data, a control command, etc. from an higher-level apparatus 2, and transmit a signal regarding a state of the image forming apparatus 1. The host apparatus 2 may be, for example but not limited to, a personal computer (PC).

The command-image processor 62 may be coupled between the I/F controller 61 and the RAMs 64. The command-image processor 62 may decompress the image data received from the I/F controller 61 into bitmap data of each of a transparent color, yellow, magenta, cyan, and black.

Each of the RAMs 64 may be a volatile memory. Each of the RAMs 64 may be coupled between the command-image processor 62 and the engine controller 63. The RAMs 64 may include, for example but not limited to, a RAM 64T that stores transparent image data, a RAM 64Y that stores yellow image data, a RAM 64M that stores magenta image data, a RAM 64C that stores cyan image data, and a RAM 64K that stores black image data. The bitmap data of each color decompressed by the command-image processor 62 may be written into the corresponding one of the RAMs 64T, 64Y, 64M, 64C, and 64K.

The high voltage supplier 65 may apply a predetermined voltage to each of the image forming units 30, the primary transfer rollers 46, and the secondary transfer roller 45, on the basis of an instruction given by the engine controller 63.

The drive controller 66A may control an operation of the driving motor 66 on the basis of an instruction given by the engine controller 63. The driving motor 66 may perform, for example but not limited to, rotation driving of each of the photosensitive drums 31, the charging rollers 32, and the developing rollers 33. Further, the driving motor 66 may transmit driving force to the driving roller 42, and to thereby cause the intermediate transfer belt 41 to be driven. Further, the driving motor 66 may drive each of the medium feeding roller 12, the pair of conveying rollers 13A and 13B, the pair of conveying rollers 15A and 15B, the pair of conveying rollers 16A and 16B, the pair of conveying rollers 17A and 17B, and the secondary transfer roller 45.

The fixing controller 105A may control a fixing operation of the fixing section 105 on the basis of an instruction given by the engine controller 63. For example, the fixing controller 105A may perform a control of a voltage to be applied to the heater 53. The fixing controller 105A may perform an ON-OFF control of the voltage to be applied to the heater 53, for example, on the basis of a temperature of the fixing section 105 measured by a thermistor.

The solenoid 14A may control an operation of the flap 14 on the basis of an instruction given by the engine controller 63.

[1-3. Workings and Effects]

[A. Basic Operation of Image Forming Apparatus 1]

The image forming apparatus 1 may form the toner image on the medium PM as follows. It is to be noted that the image forming apparatus 1 may perform transfer and fixation of the white toner image or the transparent toner image onto the medium PM, and may thereafter so perform transfer and fixation of the colored image that the colored image is superimposed on the white toner image or the transparent toner image formed on the medium PM. In other words, an image forming operation may be repeatedly performed twice on the single medium PM.

For example, first, the print data and a printing order may be supplied to the engine controller 63 of the activated image forming apparatus 1 from the host apparatus 2 via the I/F controller 61 and the command-image processor 62. The engine controller 63 may thereby cause a printing operation of the print data to be started in response to the printing order.

When the printing operation is started, the drive controller 66A may drive the driving motor 66 on the basis of the instruction given by the engine controller 63, and cause each of the photosensitive drums 31 to rotate in a predetermined rotation direction at a constant speed. When each of the photosensitive drums 31 is rotated, driving force derived from the rotation of the photosensitive drum 31 may be transmitted to corresponding one of the feeding rollers 34, corresponding one of the developing rollers 33, and corresponding one of the charging rollers 32, via a driving transmitter such as a gear train. As a result, each of the feeding rollers 34, the developing rollers 33, and the charging rollers 32 may be rotated in the predetermined direction.

Further, the drive controller 66A may drive the driving motor 66, and thereby start the rotation of the intermediate transfer belt 41, on the basis of the instruction given by the engine controller 63. Further, the high voltage supplier 65 may apply a predetermined voltage to each of the charging rollers 32 of the respective image forming units 30, and thereby electrically charge the surface of corresponding one of the photosensitive drums 31 evenly, on the basis of the instruction given by the engine controller 63.

Thereafter, the engine controller 63 may give an instruction to each of the LED heads 35, and thereby start an exposure control. Each of the LED heads 35 may apply, to corresponding one of the photosensitive drums 31, light corresponding to a color component of the printing image at timing designated by an exposure control signal, and thereby form an electrostatic latent image on the surface of the photosensitive drum 31.

Each of the developing rollers 33 may attach the developer to the electrostatic latent image on each of the photosensitive drums 31, and thereby form a toner image. The predetermined transfer voltage may be applied to each of the primary transfer rollers 46 by the high voltage supplier 65. Thereby, the toner images on the respective photosensitive drums 31 may be sequentially transferred onto the surface of the intermediate transfer belt 41 and superimposed on each other in the primary transfer section T1 in which the primary transfer rollers 46 and the photosensitive drums 31 sandwich the intermediate transfer belt 41 in between. It is to be noted that, upon the image forming operation for the first time, only the transparent toner image or only the white toner image may be transferred onto the surface of the intermediate transfer belt 41.

Thereafter, the drive controller 66A may activate the driving motor 66, and cause conveyance of the medium PM to be started, on the basis of the instruction given by the engine controller 63. This conveyance control may cause the medium PM to be conveyed toward the secondary transfer section T2 at a predetermined conveyance speed. For example, referring to FIG. 1, the medium PM contained in the medium cassette 11 may first be picked up by the medium feeding roller 12 one by one from the top, and be fed toward the pair of conveying rollers 13A and 13B. The medium PM fed from the medium feeding roller 12 may be conveyed to the secondary transfer section T2 along the conveyance path P4 via the pair of conveying rollers 16A and 16B and the pair of conveying rollers 17A and 17B after a skew of the medium PM is corrected by the pair of conveying rollers 13A and 13B.

In one example, when a tip position of the medium PM is detected by the position sensor, a detection signal may be transmitted to the engine controller 63. The engine controller 63 may adjust the conveyance speed of the medium PM and a linear speed of the surface of the intermediate transfer belt 41, and thereby align the medium PM with the transparent toner image or the white toner image on the intermediate transfer belt 41. This may cause the transparent toner image or the white toner image on the intermediate transfer belt 41 to be subjected to secondary transfer in a predetermined region of the medium PM, at a position of the secondary transfer section T2, i.e., a position at which the backup roller 44 and the secondary transfer roller 45 face each other. Thereafter, the fixing section 105 may apply heat and pressure to the transparent toner image or the white toner image that has been transferred onto the medium PM, and thereby fix the transparent toner image or the white toner image to the medium PM. This may complete the image forming operation for the first time on the medium PM.

The medium PM to which the transparent toner image or the white toner image is fixed as a first layer may be discharged from the fixing section 105 toward the downstream of the fixing section 105. On this occasion, the solenoid 14A may be driven on the basis of an instruction given by the engine controller 63. The solenoid 14A may thereby move the flap 14 to a position at which the flap 14 blocks the conveyance path PL2 and guides the medium PM into the conveyance path PL3.

Thereafter, the image forming operation for the second time on the medium PM may be performed basically in a manner similar to that of the image forming operation for the first time. The medium PM to be subjected to the image forming operation for the second time may have traveled along the conveyance path PL3 and has returned again to the conveyance path PL1. Upon the image forming operation for the second time, however, the colored toner image may be formed as a second layer on the transparent toner image or the white toner image that has been formed on the medium PM as the first layer. For example, the primary transfer section T1 may sequentially transfer, onto the intermediate transfer belt 41, the yellow toner image, the magenta toner image, the cyan toner image, and the black toner image on the respective photosensitive drums 31, and thereby allow the yellow toner image, the magenta toner image, the cyan toner image, and the black toner image to be superimposed on each other, on an as-needed basis. Thereafter, the secondary transfer section T2 may so transfer, as the second layer, the colored toner image formed on the surface of the intermediate transfer belt 41 that the colored toner image is superimposed on the transparent toner image or the white toner image formed on the medium PM as the first layer. In other words, the secondary transfer section T2 may perform such secondary transfer. Thereafter, the fixing section 105 may perform the fixing operation of the colored toner image formed as the second layer. This may complete the image forming operation for the second time, and the medium PM may be discharged to the placement tray 100K provided outside the housing 100. Upon the discharging of the medium PM to the placement tray 100K, the solenoid 14A may be driven on the basis of the instruction given by the engine controller 63 to thereby cause the flap 14 to be moved to a position at which the flap 14 blocks the conveyance path PL3 and guides the medium PM discharged from the fixing section 105 into the conveyance path PL2.

[B. Detailed Operation of Secondary Transfer Section T2]

A detailed description is given below of an operation of the secondary transfer section T2, with reference to FIGS. 5A to 5D. FIGS. 5A to 5D schematically illustrate, in order, respective cross-sections of processes of forming an image on the medium PM. The secondary transfer section T2 may perform transfer of the transparent toner image or the white toner image as the first layer onto the medium PM on the basis of a first transfer condition, and perform transfer of the colored toner image as the second layer onto the medium PM on the basis of a second transfer condition. The second transfer condition may be different from the first transfer condition. In one example, the first transfer condition and the second transfer condition may be related to magnitude of a difference between the linear speed of the surface of the intermediate transfer belt 41 and the conveyance speed of the medium PM passing through the secondary transfer section T2.

In one example, the following conditional expression (1) and the following conditional expression (2) may be satisfied.

$$(Vd1-Vt1)/Vt1>(Vd2-Vt2)/Vt2 \quad (1)$$

$$Vd1>Vt1 \quad (2)$$

In the foregoing conditional expression (1) and the foregoing conditional expression (2), "Vd1" is the linear speed of the surface of the intermediate transfer belt 41, i.e., the surface, of the intermediate transfer belt 41, that comes into contact with the medium PM, at the time when the transfer of the transparent toner image or the white toner image as the first layer is executed. The linear speed Vd1 of the surface of the intermediate transfer belt 41 may correspond to a "first linear speed" in one specific but non-limiting embodiment of the technology. "Vt1" is the conveyance speed of the medium PM passing through the secondary transfer section T2 at the time when the transfer of the transparent toner image or the white toner image as the first layer is executed. The conveyance speed Vt1 of the medium PM may correspond to a "first conveyance speed" in one specific but non-limiting embodiment of the technology. "Vd2" is the linear speed of the surface of the intermediate transfer belt 41 at the time when the transfer of the colored toner image as the second layer is executed. The linear speed Vd2 of the surface of the intermediate transfer belt 41 may correspond to a "second linear speed" in one specific but non-limiting embodiment of the technology. "Vt2" is the conveyance speed of the medium PM passing through the secondary transfer section T2 at the time when the transfer of the colored toner image as the second layer is executed. The conveyance speed Vt2 of the medium PM may correspond to a "second conveyance speed" in one specific but non-limiting embodiment of the technology. Further, the transparent toner image as the first layer may correspond to a "first toner image" in one specific but non-limiting embodiment of the technology. The colored toner image as the second layer may correspond to a "second toner image" in one specific but non-limiting embodiment of the technology. Each of the linear speeds Vd1 and Vd2 and the conveyance speeds Vt1 and Vt2 may be varied by adjusting a factor such as a rotation ratio of the driving motor 66 relative to the driving roller 42, or a rotation ratio of the driving motor 66 relative to the pair of conveying rollers 16A and 16B and the pair of conveying rollers 17A and 17B. It is to be noted that, as used herein, the term "speed ratio VR1" may refer to the left side of the conditional expression (1), i.e., (Vd1−Vt1)/Vt1, in some cases. Further, the term "speed ratio VR2" may refer to the right side of the conditional expression (1), i.e., (Vd2−Vt2)/Vt2 in some cases.

Figure 5A:
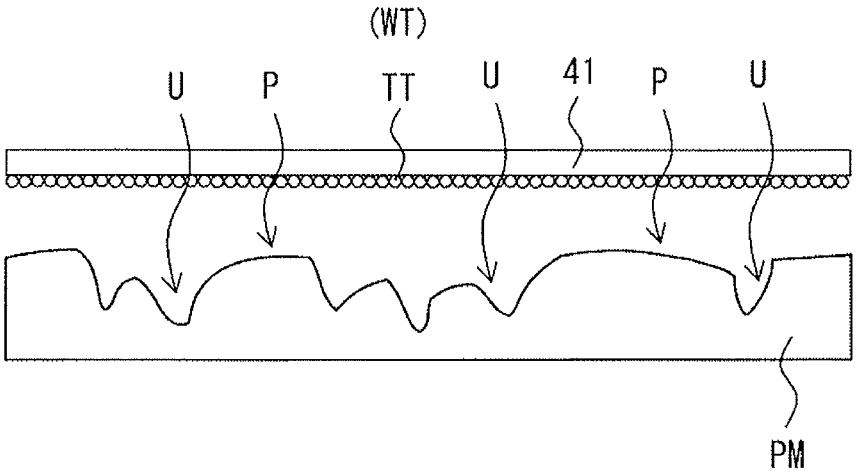
FIG. 5A is a schematic cross-sectional view of a process of forming an image in a transfer section illustrated in FIG. 1.
Figure 5B:
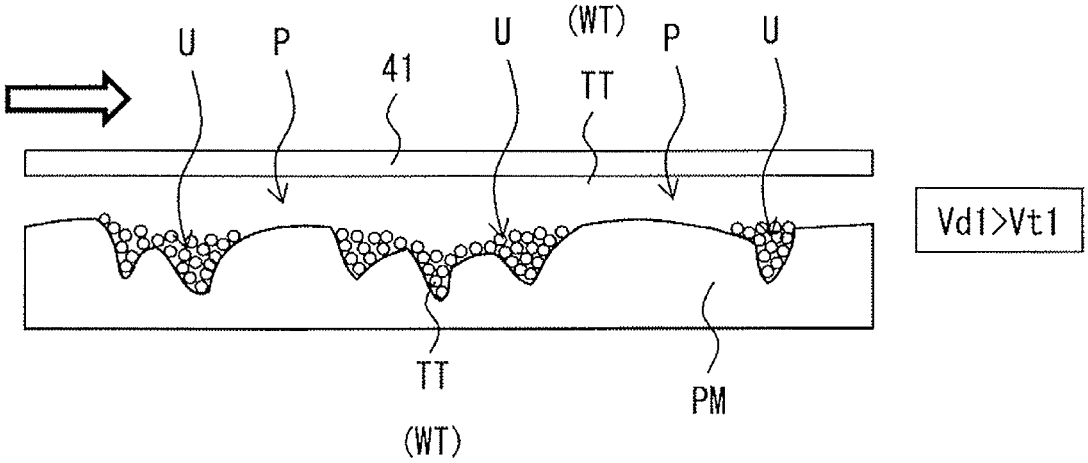
FIG. 5B is a schematic cross-sectional view of a process following the process illustrated in FIG. 5A.

A description is given below of an example case where the transparent toner image TT or the white toner image WT may be formed as the first layer, and the colored image including the yellow toner image YT, the magenta toner image MT, and the cyan toner image CT may be formed as the second layer. Upon transferring the transparent toner image TT or the white toner image WT onto the medium PM as the first layer, first, referring to FIG. 5A, the primary transfer section T1 may so perform primary transfer as to transfer, onto the intermediate transfer belt 41, the transparent toner image TT or the white toner image WT that has been formed by the image forming unit 30T or 30W. It is to be noted that the surface of the intermediate transfer belt 41 may be relatively flat; however, the surface of the medium PM onto which the image is to be transferred may have depressions U and protrusions P that are provided side by side irregularly, for example. Thereafter, referring to FIG. 5B, the secondary transfer section T2 may transfer the transparent toner image TT or the white toner image WT onto the medium PM. In one example, upon the transfer of the transparent toner image TT or the white toner image WT onto the medium PM, the linear speed Vd1 of the intermediate transfer belt 41 may be higher than the conveyance speed Vt1 of the medium PM (Vd1>Vt1). It is to be noted that FIG. 5B illustrates a state that is immediately after a portion of the intermediate transfer belt 41 and a portion of the medium PM that face each other have been brought into contact sequentially from the left side to the right side of the paper plane of FIG. 5B, and the secondary transfer has been thereby performed. As illustrated in FIG. 5B, the depressions U may be filled with the transparent toner image TT or the white toner image WT at relatively-high density. In contrast, the transparent toner image TT or the white toner image WT may be hardly transferred onto the protrusions P. One possible reason for this is that contact stress between the protrusions P and the intermediate transfer belt 41 is greater than the contact stress between the depressions U and the intermediate transfer belt 41. Therefore, the protrusions P and the intermediate transfer belt 41 may come into contact with each other; however, the depressions U and the intermediate transfer belt 41 may hardly come into contact with each other. In this example, the linear speed Vd1 of the intermediate transfer belt 41 may be higher than the conveyance speed Vt1 of the medium PM (Vd1>Vt1). Therefore, the contact stress between the protrusions P and the intermediate transfer belt 41 may be sufficiently greater than the contact stress between the depressions U and the intermediate transfer belt 41. Accordingly, a transfer current that is greater than a transfer current that passes through the depressions U may pass through the protrusions P in a thickness direction of the medium PM. This may presumably results in a decrease in transfer efficiency at the protrusions P, and results in filling of the depressions U with the transparent toner image TT or the white toner image WT at relatively-high density accordingly.

Figure 5C:
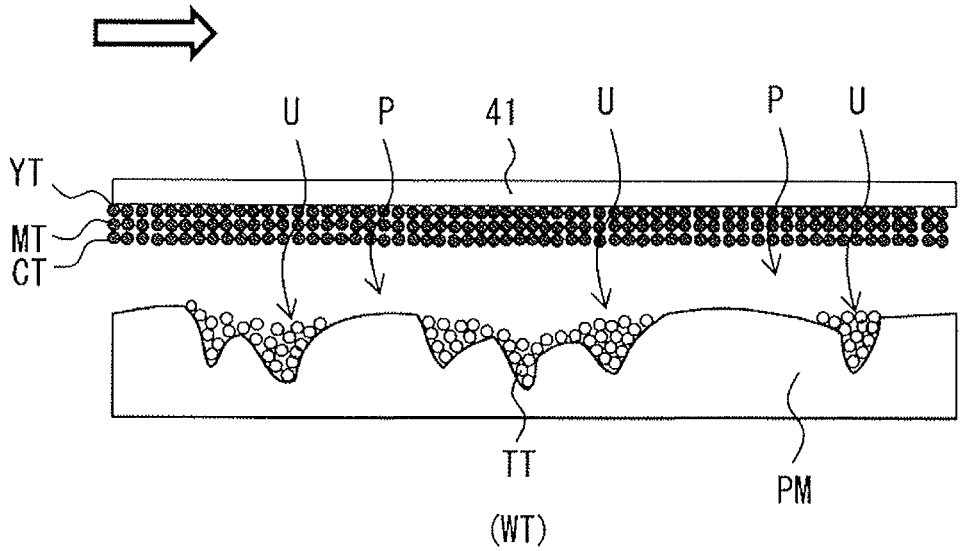
FIG. 5C is a schematic cross-sectional view of a process following the process illustrated in FIG. 5B.

After the operations of transferring the transparent toner image TT or the white toner image WT onto the medium PM as the first layer and fixing the transferred transparent toner image TT or the transferred white toner image WT to the medium PM are completed, the primary transfer may be so performed as to transfer, for example, the yellow toner image YT, the magenta toner image MT, and the cyan toner image CT in order onto the intermediate transfer belt 41, as illustrated in FIG. 5C. It is to be noted that the remains of the transparent toner image TT or the white toner image WT on the surface of the intermediate transfer belt 41 may be removed beforehand by the cleaning blade 47. In this example, on the surface of the medium PM, the depressions U may be so filled with the transparent toner image TT or the white toner image WT in a concentrated manner that the depressions U are full of the transparent toner image TT or the white toner image WT.

Figure 5D:
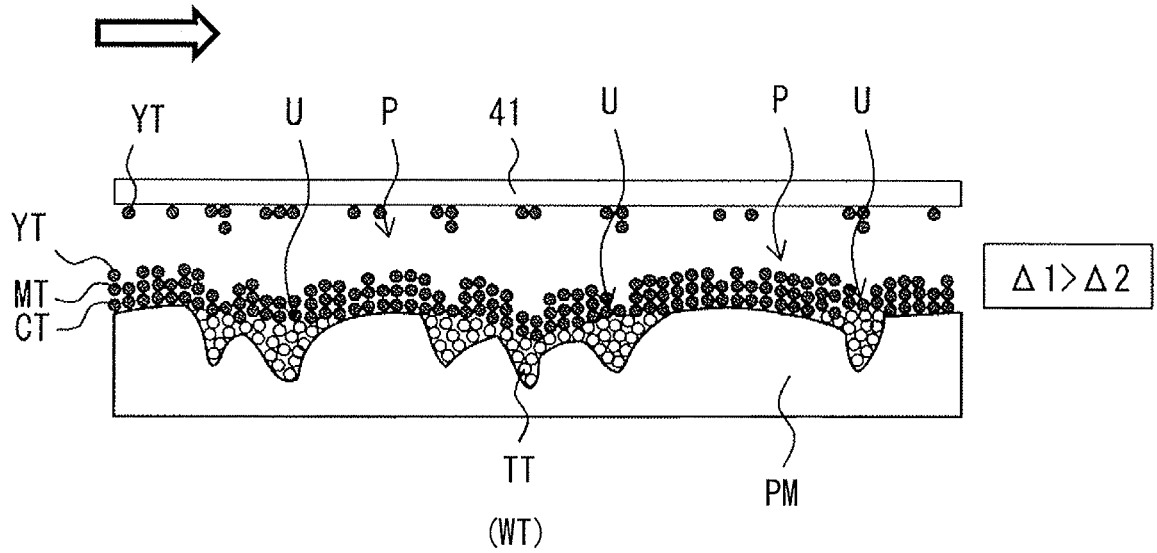
FIG. 5D is a schematic cross-sectional view of a process following the process illustrated in FIG. 5C.

Thereafter, referring to FIG. 5D, the secondary transfer section T2 may so transfer the yellow toner image YT, the magenta toner image MT, and the cyan toner image CT that the yellow toner image YT, the magenta toner image MT, and the cyan toner image CT are superimposed on the transparent toner image TT or the white toner image WT on the medium PM. Upon this transfer, a difference Δ2 may be caused to be smaller than a difference Δ1 (Δ1>Δ2), for example, by causing the conveyance speed Vt2 to be higher than the conveyance speed Vt1 (Vt1<Vt2), while causing the linear speed Vd2 of the intermediate transfer belt 41 to be substantially equal to the foregoing linear speed Vd1 (Vd1=Vd2). The difference Δ1 is a result of subtracting the conveyance speed Vt1 of the medium PM from the linear speed Vd1 of the intermediate transfer belt 41 (Vd1−Vt1). The difference Δ2 is a result of subtracting the conveyance speed Vt2 of the medium PM from the linear speed Vd2 of the intermediate transfer belt 41 (Vd2−Vt2). In other words, the speed ratio VR1 may be caused to be greater than the speed ratio VR2 (VR1>VR2). It is to be noted that the linear speed Vd2 and the conveyance speed Vt2 may be substantially equal to each other. As a result, the yellow toner image YT, the magenta toner image MT, and the cyan toner image CT may be transferred more evenly at the protrusions P and the depressions U, as illustrated in FIG. 5D. Part of the colored image, for example, part of the yellow toner image YT, however, may remain on the intermediate transfer belt 41 without having been removed from the intermediate transfer belt 41. It is to be noted that FIG. 5D illustrates a state that is immediately after a portion of the intermediate transfer belt 41 and a portion of the medium PM that face each other have been brought into contact sequentially from the left side to the right side of the paper plane of FIG. 5D, and the secondary transfer has been thereby performed, as with FIG. 5B.

[C. Example Effects]

According to the first example embodiment, the transparent toner image or the white toner image may be formed as the first layer, and thereafter, the colored toner image may be formed as the second layer, as described above. Accordingly, the secondary transfer may be so performed that the colored image is transferred onto the medium PM in accordance with the irregularities on the medium PM, even when the medium PM has a surface with large irregularities. This improves an amount at which the depressions U are filled with the colored toner image, reproducibility of fine lines, etc., thereby achieving formation of an image having higher quality. In one example, the transparent toner image or the white toner image of the first layer may be so transferred that the transparent toner image or the white toner image may be selectively transferred onto the depressions U in a concentrated manner, by so performing the secondary transfer that the foregoing conditional expressions (1) and (2) are both satisfied. Accordingly, the colored toner image, as the second layer to be formed on the transparent toner image or the white toner image of the first layer, is transferred onto the depressions U with certainty. Hence, it is possible to achieve formation of an image having higher quality.

2. SECOND EXAMPLE EMBODIMENT

[2-1. Outline]

A description is given next of an image forming apparatus 1A according to a second example embodiment of the technology. The image forming apparatus 1 according to the foregoing first example embodiment may form the transparent toner image or the white toner image on the medium PM and fix the formed transparent toner image or the formed white toner image to the medium PM, as the image forming operation for the first time. Further, the image forming apparatus 1 according to the foregoing first example embodiment may transfer the colored toner image onto the foregoing transparent toner image or the foregoing white toner image and fix the transferred colored toner image, as the image forming operation for the second time. In contrast, the image forming apparatus 1A according to the second example embodiment may form the transparent toner image or the white toner image on the medium PM and fix the formed transparent toner image or the formed white toner image to the medium PM, as the image forming operation for the first time. Further, the image forming apparatus 1A according to the second example embodiment may transfer together the colored toner image and the transparent toner image that are superimposed on each other, and fix together the colored toner image and the transparent toner image that are superimposed on each other, as the image forming operation for the second time.

[2-2. Detailed Operations of Image Forming Section 103 and Transfer Section 104]

A detailed description is given below of operations of the image forming section 103 and the transfer section 104 according to the second example embodiment, with reference to FIGS. 6A to 6D. FIGS. 6A to 6D schematically illustrate, in order, respective cross-sections of processes of forming an image on the medium PM. The image forming section 103 according to the second example embodiment may execute a first image forming operation and a second image forming operation. The first image forming operation may form a first transparent toner image or a white toner image. The second image forming operation may sequentially form a second transparent toner image and a colored toner image after the first image forming operation is performed. Further, the transfer section 104 according to the second example embodiment may execute a first transfer operation and a second transfer operation. The first transfer operation may transfer the first transparent toner image or the white toner image onto the medium PM before the second image forming operation is performed. The second transfer operation may so transfer the colored toner image and the second transparent toner image that the colored toner image and the second transparent toner image are stacked in order on the first transparent toner image or the white toner image that has been transferred onto the medium PM. In this example, the first transparent toner image or the white toner image may correspond to the "first toner image" in one specific but non-limiting embodiment of the technology. The second transparent toner image may correspond to the "second toner image" in one specific but non-limiting embodiment of the technology. The colored toner image may correspond to a "third toner image" in one specific but non-limiting embodiment of the technology.

A description is given below of an example case, where, in the image forming operation for the first time, a transparent toner image TT1 as the first transparent toner image may be formed on the medium PM and the formed transparent toner image TT1 may be fixed, and where, in the image forming operation for the second time, the colored toner image including the cyan toner image CT, the magenta toner image MT, and the yellow toner image YT, and a transparent toner image TT2 as the second transparent toner image may be formed on the transparent toner image TT1, and the formed colored toner image and the formed transparent toner image TT2 may be fixed.

Figure 6A:
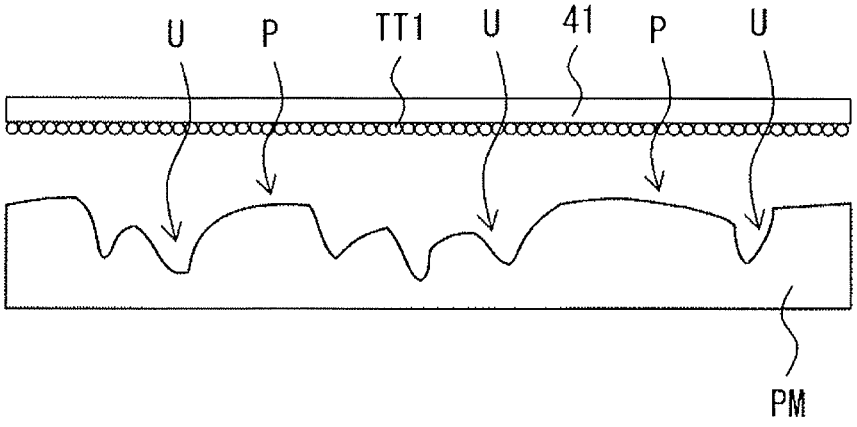
FIG. 6A is a schematic cross-sectional view of a process of forming an image in a transfer section of an image forming apparatus according to a second example embodiment of the technology.
Figure 6B:
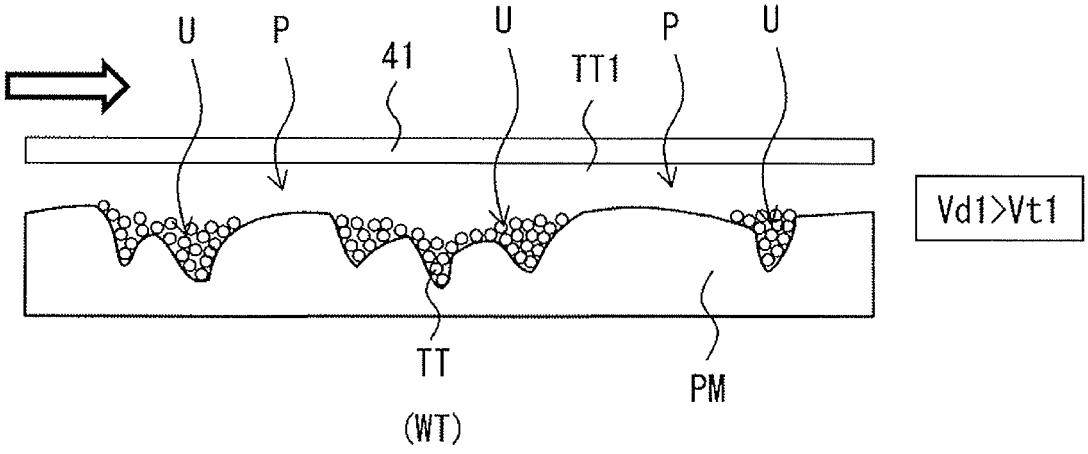
FIG. 6B is a schematic cross-sectional view of a process following the process illustrated in FIG. 6A.

Upon transferring the transparent toner image TT1 onto the medium PM, primary transfer may be so performed as to transfer, onto the intermediate transfer belt 41, the transparent toner image TT1 that has been formed by the image forming unit 30T, as illustrated in FIG. 6A, as in the foregoing first example embodiment. It is to be noted that the surface of the intermediate transfer belt 41 may be relatively flat; however, the surface of the medium PM onto which the image is to be transferred may have depressions U and protrusions P that are provided side by side irregularly, for example. Thereafter, referring to FIG. 6B, the secondary transfer section T2 may transfer the transparent toner image TT1 onto the medium PM. Upon the transfer of the transparent toner image TT1 onto the medium PM, the linear speed Vd1 of the intermediate transfer belt 41 may be higher than the conveyance speed Vt1 of the medium PM (Vd1>Vt1) in one example. It is to be noted that FIG. 6B illustrates a state that is immediately after a portion of the intermediate transfer belt 41 and a portion of the medium PM that face each other have been brought into contact sequentially from the left side to the right side of the paper plane of FIG. 6B, and the secondary transfer has been thereby performed. It can be appreciated from FIG. 6B that the depressions U are filled with the transparent toner image TT1 at relatively-high density, whereas the transparent toner image TT1 is hardly transferred onto the protrusions P. One possible reason for this is similar to that described in the foregoing first example embodiment.

Figure 6C:
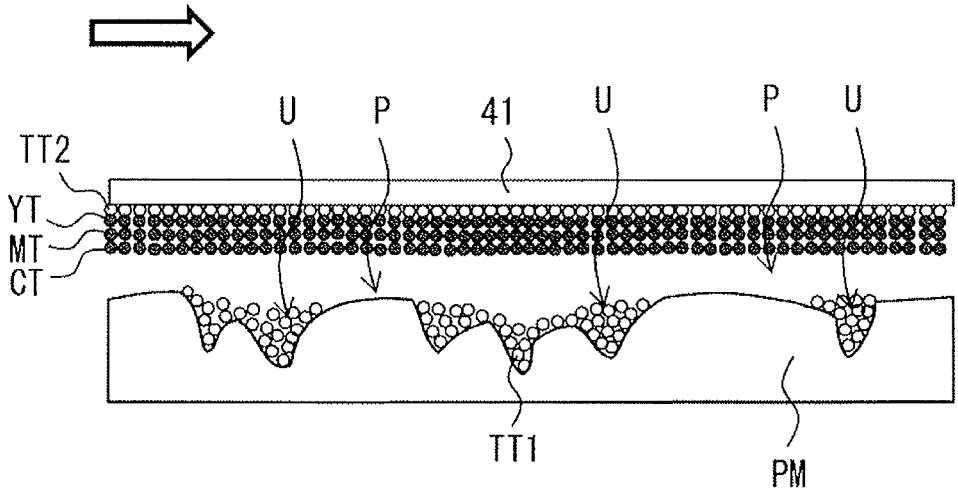
FIG. 6C is a schematic cross-sectional view of a process following the process illustrated in FIG. 6B.

After the operations of transferring the transparent toner image TT1 onto the medium PM and fixing the transferred transparent toner image TT1 are completed, the primary transfer may be so performed as to transfer, for example, the second transparent toner image (the transparent toner image TT2) and the colored toner image (for example, the yellow toner image YT, the magenta toner image MT, and the cyan toner image CT) in order onto the intermediate transfer belt 41, as illustrated in FIG. 6C. It is to be noted that the remains of the transparent toner image TT1 on the surface of the intermediate transfer belt 41 may be removed beforehand by the cleaning blade 47. On this occasion, on the surface of the medium PM, the depressions U may be so filled with the transparent toner image TT1 in a concentrated manner that the depressions U are full of the transparent toner image TT1.

Figure 6D:
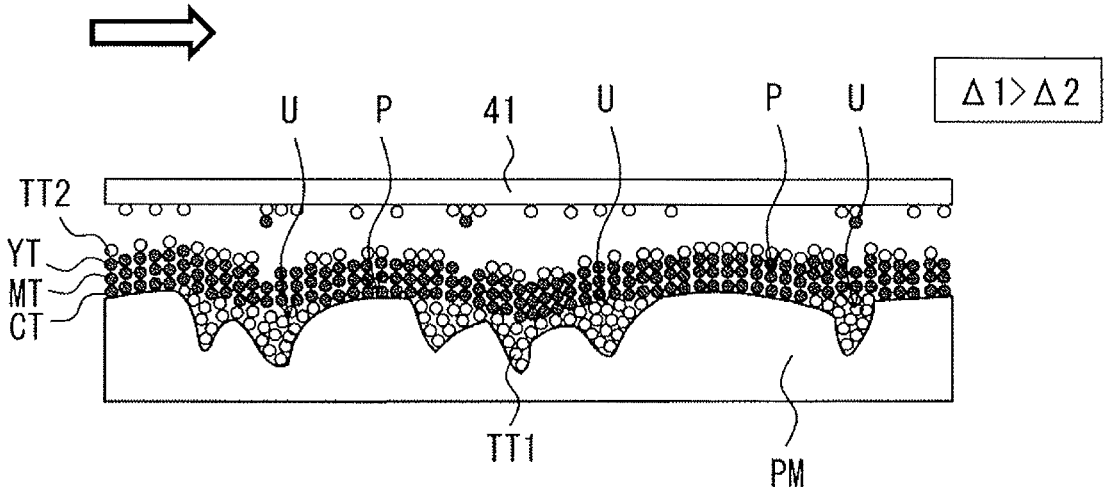
FIG. 6D is a schematic cross-sectional view of a process following the process illustrated in FIG. 6C.

Thereafter, referring to FIG. 6D, the secondary transfer section T2 may so transfer the cyan toner image CT, the magenta toner image MT, the yellow toner image YT, and the transparent toner image TT2 that the cyan toner image CT, the magenta toner image MT, the yellow toner image YT, and the transparent toner image TT2 are superimposed on the transparent toner image TT1 on the medium PM. Upon this transfer, the foregoing conditional expression (1) may be satisfied. For example, the difference Δ2 may be caused to be smaller than the difference Δ1 (Δ1>Δ2), for example, by causing the conveyance speed Vt2 to be higher than the conveyance speed Vt1 (Vt1<Vt2), while causing the linear speed Vd2 of the intermediate transfer belt 41 to be substantially equal to the foregoing linear speed Vd1 (Vd1=Vd2). The difference Δ1 is a result of subtracting the conveyance speed Vt1 of the medium PM from the linear speed Vd1 of the intermediate transfer belt 41 (Vd1−Vt1). The difference Δ2 is a result of subtracting the conveyance speed Vt2 of the medium PM from the linear speed Vd2 of the intermediate transfer belt 41 (Vd2−Vt2). In other words, the speed ratio VR1 may be caused to be greater than the speed ratio VR2 (VR1>VR2). It is to be noted that the linear speed Vd2 and the conveyance speed Vt2 may be substantially equal to each other. As a result, the yellow toner image YT, the magenta toner image MT, and the cyan toner image CT may be transferred more evenly at the protrusions P and the depressions U, as illustrated in FIG. 6D. It is to be noted that FIG. 6D illustrates a state that is immediately after a portion of the intermediate transfer belt 41 and a portion of the medium PM that face each other have been brought into contact sequentially from the left side to the right side of the paper plane of FIG. 6D, and the secondary transfer has been thereby performed, as with FIG. 6B. Referring to FIG. 6D, the cyan toner image CT, the magenta toner image MT, and the yellow toner image YT may be transferred more evenly at the protrusions P and the depressions U. It is to be noted that, however, much of the transparent toner image TT2 may remain on the intermediate transfer belt 41 without having been removed from the intermediate transfer belt 41. However, the transparent toner image TT2 may serve as a sacrifice layer in the secondary transfer section T2. This prevents part of the colored toner image, for example, the yellow toner image YT, from remaining on the intermediate transfer belt 41. It is to be noted that FIGS. 6A to 6D refer to the example case where the transparent toner image TT1 as the first transparent toner image may be formed on the medium PM and the formed transparent toner image TT1 may be fixed in the image forming operation for the first time; however, the technology is not limited thereto. Alternatively, for example, the white toner image may be formed on the medium PM and the formed white toner image may be fixed, in the image forming operation for the first time. Further, in accordance with the color of the medium PM, a toner image of each of the colors including yellow, cyan, magenta, and black may be formed and the formed toner image may be fixed. Alternatively, a toner image of a mixed color derived from mixing of a plurality of colors of the foregoing colors may be formed and the formed toner image may be fixed.

[2-3. Example Effects]

Also according to the second example embodiment, the first transparent toner image or the white toner image may be formed as the first layer, and thereafter, the colored toner image may be formed as the second layer, as described above. Accordingly, the secondary transfer may be so performed that the colored toner image is transferred onto the medium PM in accordance with the irregularities on the medium PM, even when the medium PM has a surface with large irregularities. This improves an amount at which the depressions U are filled with the colored toner image, reproducibility of fine lines, etc., thereby achieving improved image formation. In one example, the transparent toner image or the white toner image of the first layer may be so transferred that the transparent toner image or the white toner image may be selectively transferred onto the depressions U in a concentrated manner, by so performing the secondary transfer that the foregoing conditional expressions (1) and (2) are both satisfied. Accordingly, the colored toner image, as the second layer to be formed on the transparent toner image or the white toner image of the first layer, is transferred onto the depressions U with certainty. Hence, it is possible to achieve formation of an image with higher quality. According to the second example embodiment, the second transparent toner image may be formed in addition between the colored toner image and the intermediate transfer belt 41. This allows, upon the secondary transfer, most of the colored toner image to be moved onto the medium PM without remaining on the intermediate transfer belt 41. Accordingly, desired printing density is secured. Hence, it is possible to achieve formation of an image having further higher quality.

3. EXPERIMENT EXAMPLES

Experiment Example 1-1

An image including the first transparent toner image, the colored toner image, and the second transparent toner image in order was printed on the medium PM, by the procedures described above in the second example embodiment. As the medium PM, Lethac 66 as embossed paper available from Tokushu Tokai Paper Co., Ltd., Shizuoka, Japan was used. The experiment was performed under an environment having a room temperature of 23 degrees centigrade and humidity of 50%. In this experiment, first, the following was performed as the image forming operation for the first time. That is, the primary transfer was so performed as to transfer the first transparent toner image at a duty ratio of 100% onto the entire surface of the intermediate transfer belt 41 by the use of the transparent toner (C941 available from Oki Data Corporation, Tokyo, Japan). Thereafter, the secondary transfer was so performed as to transfer the first transparent toner image onto the medium PM and the transferred first transparent toner image was fixed. Thereafter, the following was performed as the image forming operation for the second time. That is, the primary transfer was so performed as to transfer the second transparent toner image at the duty ratio of 100% by the use of the transparent toner onto the entire surface of the intermediate transfer belt 41. The primary transfer was also so performed as to transfer, as the colored toner image, a fine line pattern at a duty ratio of 40% by the use of the cyan toner, onto the second transparent image. Thereafter, the secondary transfer was performed. Upon the secondary transfer, the second transparent toner image and the colored toner image were so transferred that the second transparent toner image and the colored toner image were superimposed on the first transparent toner image on the medium PM, and the transferred second transparent toner image and the transferred colored toner image were fixed. The fine line pattern herein refers to a pattern in which a plurality of fine lines each having a width of 60 μm are formed adjacent to each other at intervals of 80 μm. Further, upon the secondary transfer of the first transparent toner image, the linear speed Vd1 of the intermediate transfer belt 41 and the conveyance speed Vt1 of the medium PM in the secondary transfer section T2 were each set to 86 mm/sec. Also upon the secondary transfer of the second transparent toner image and the colored toner image, the linear speed Vd2 of the intermediate transfer belt 41 and the conveyance speed Vt2 of the medium PM in the secondary transfer section T2 were each set to 86 mm/sec. Further, the transfer voltage at the time when the secondary transfer of the first transparent toner image was performed was set to 1800 V, and the transfer voltage at the time when the secondary transfer of the second transparent toner image and the colored toner image was performed was also set to 1800 V. For the image on the medium PM thus obtained, a colored toner filling amount by which the depressions U were filled with the colored toner was evaluated, and reproducibility of the fine lines was also evaluated. Table 1 describes results of the evaluations.

TABLE 1

| | Formed image configuration | | Speed ratio [%] | | Image evaluation | |
|---|---|---|---|---|---|---|
| | First time | Second time | VR1 | VR2 | Filling amount | Reproducibility of fine lines |
| Experiment example 1-1 | First transparent toner image | Colored toner image/Second transparent toner image | 100 | 100 | B | B |
| Experiment example 1-2 | First transparent toner image | Colored toner image/Second transparent toner image | 95 | 100 | B | B |
| Experiment example 1-3 | First transparent toner image | Colored toner image/Second transparent toner image | 102.5 | 100 | A | B |
| Experiment example 1-4 | First transparent toner image | Colored toner image/Second transparent toner image | 104 | 100 | A | S |
| Experiment example 1-5 | First transparent toner image | Colored toner image/Second transparent toner image | 107 | 100 | S | S |
| Experiment example 1-6 | First transparent toner image | Colored toner image/Second transparent toner image | 110 | 100 | S | S |

It is to be noted that the colored toner filling amount herein is defined as a ratio of a weight per unit area of the colored toner that configures the colored toner image attached to the depressions on the medium PM, relative to a weight per unit area of the colored toner that configures the colored toner image attached to the protrusions on the medium PM. The colored toner filling amount that was equal to or higher than 80% was evaluated as "excellent" and is described as "S" in Table 1. The colored toner filling amount that was equal to or higher than 65% and lower than 80% was evaluated as "good" and is described as "A" in Table 1. The colored toner filling amount that was equal to or higher than 50% and lower than 65% was evaluated as "fair" and is described as "B" in Table 1. The colored toner filling amount that was lower than 50% was evaluated as "poor" and is described as "F" in Table 1. Further, the reproducibility of the fine lines herein refers to distinguishability, from each other, of the fine line patterns that are adjacent to each other and printed on the protrusions P and the depressions U on the medium PM. Specifically, a case where the fine line pattern was printed clearly on both of the protrusions P and the depressions U, and visual distinction between the fine lines was sufficiently possible, was evaluated as "excellent" and is described as "S" in Table 1. A case where a difference was visually recognized between the fine line pattern printed on the protrusions P and the fine line pattern printed on the depressions U, however, the visual distinction between the fine lines was possible without any problem, was evaluated as "good" and is described as "A"

in Table 1. A case where an edge of the fine line pattern printed on the depressions U was slightly blurred compared to the fine line pattern printed on the protrusions P, however, the visual distinction between the fine lines was possible, was evaluated as "fair" and is described as "B" in Table 1. A case where the distinction between the adjacent fine lines was difficult at the depressions U, was evaluated as "poor" and is described as "F" in Table 1. It is to be noted that the image forming apparatus that was evaluated as "S" or "A" for both of the colored toner filling amount and the reproducibility of the fine lines had the level that allowed the image forming apparatus to be sufficiently usable as a product.

Experiment Examples 1-2 to 1-6

In each of Experiment examples 1-2 to 1-6, an image was printed on the medium PM and evaluation was performed in a manner similar to that in Experiment example 1-1, except that the speed ratio VR1 that equaled (Vd1−Vt1)/Vt1 and the speed ratio VR2 that equaled (Vd2−Vt2)/Vt2 were different from each other.

Experiment Example 1-2

Specifically, in Experiment Example 1-2, the conveyance speed Vt1 of the medium PM was set to about 90.3 mm/sec while the linear speed Vd1 of the intermediate transfer belt 41 was set to 86 mm/sec, upon the secondary transfer of the first transparent toner image. The speed ratio VR1 was thereby caused to be −5% relative to the speed ratio VR2. Accordingly, the speed ratio VR1 was made smaller than the speed ratio VR2 (VR1<VR2) in Experiment Example 1-2.

Experiment Example 1-3

In Experiment Example 1-3, the conveyance speed Vt1 of the medium PM was set to about 83.9 mm/sec while the linear speed Vd1 of the intermediate transfer belt 41 was set to 86 mm/sec, upon the secondary transfer of the first transparent toner image. The speed ratio VR1 was thereby caused to be +2.5% relative to the speed ratio VR2. Accordingly, the speed ratio VR1 was made greater than the speed ratio VR2 (VR1>VR2) in Experiment Example 1-3.

Experiment Example 1-4

In Experiment Example 1-4, the conveyance speed Vt1 of the medium PM was set to about 82.6 mm/sec while the linear speed Vd1 of the intermediate transfer belt 41 was set to 86 mm/sec, upon the secondary transfer of the first transparent toner image. The speed ratio VR1 was thereby caused to be +4.0% relative to the speed ratio VR2. Accordingly, the speed ratio VR1 was made greater than the speed ratio VR2 (VR1>VR2) in Experiment Example 1-4.

Experiment Example 1-5

In Experiment Example 1-5, the conveyance speed Vt1 of the medium PM was set to about 80.0 mm/sec while the linear speed Vd1 of the intermediate transfer belt 41 was set to 86 mm/sec, upon the secondary transfer of the first transparent toner image. The speed ratio VR1 was thereby caused to be +7.0% relative to the speed ratio VR2. Accordingly, the speed ratio VR1 was made greater than the speed ratio VR2 (VR1>VR2) in Experiment Example 1-5.

Experiment Example 1-6

In Experiment Example 1-6, the conveyance speed Vt1 of the medium PM was set to about 77.4 mm/sec while the linear speed Vd1 of the intermediate transfer belt 41 was set to 86 mm/sec, upon the secondary transfer of the first transparent toner image. The speed ratio VR1 was thereby caused to be +10.0% relative to the speed ratio VR2. Accordingly, the speed ratio VR1 was made greater than the speed ratio VR2 (VR1>VR2) in Experiment Example 1-6. Table 2 describes results of the evaluations in Experiment examples 1-2 to 1-6 together.

Experiment Examples 2-1 to 2-6

An image including the transparent toner image and the colored toner image in order was printed on the medium PM by the procedures described above in the first example embodiment. Specifically, only transfer and fixing of the colored toner image were performed without performing transfer and fixing of the second transparent image, as the image forming operation for the second time. In each of Experiment examples 2-1 to 2-6, the image was printed on the medium PM and evaluation was performed in a manner similar to that of corresponding one of Experiment examples 1-1 to 1-6 for other points excluding the foregoing point. Table 2 describes results of the evaluations in Experiment examples 2-1 to 2-6.

TABLE 2

| | Formed image configuration | | Speed ratio [%] | | Image evaluation | |
|---|---|---|---|---|---|---|
| | First time | Second time | VR1 | VR2 | Filling amount | Reproducibility of fine lines |
| Experiment example 2-1 | First transparent toner image | Colored toner image | 100 | 100 | B | B |
| Experiment example 2-2 | First transparent toner image | Colored toner image | 95 | 100 | B | B |
| Experiment example 2-3 | First transparent toner image | Colored toner image | 102.5 | 100 | A | B |
| Experiment example 2-4 | First transparent toner image | Colored toner image | 104 | 100 | A | A |

TABLE 2-continued

| | Formed image configuration | | Speed ratio [%] | | Image evaluation | |
|---|---|---|---|---|---|---|
| | First time | Second time | VR1 | VR2 | Filling amount | Reproducibility of fine lines |
| Experiment example 2-5 | First transparent toner image | Colored toner image | 107 | 100 | A | A |
| Experiment example 2-6 | First transparent toner image | Colored toner image | 110 | 100 | A | A |

Experiment Example 3-1

The colored toner image was transferred onto the medium PM and the transferred colored image was fixed, without performing the image forming operation for the first time (formation of the first transparent toner image). In Experiment example 3-1, the image was printed on the medium PM and evaluation was performed in a manner similar to that in Experiment example 2-1 for other points excluding the foregoing point. Table 3 describes a result of the evaluation in Experiment example 3-1.

TABLE 3

| | Formed image configuration | | Speed ratio [%] | | Image evaluation | |
|---|---|---|---|---|---|---|
| Table 3 | First time | Second time | VR1 | VR2 | Filling amount | Reproducibility of fine lines |
| Experiment example 3-1 | — | Colored toner image | — | 100 | F | F |
| Experiment example 3-2 | — | Colored toner image/Transparent toner image | — | 100 | A | F |

Experiment Example 3-2

The colored toner image and the transparent toner image were transferred onto the medium PM and the transferred colored toner image and the transferred transparent toner image were fixed, without performing the image forming operation for the first time (formation of the first transparent image). In Experiment example 3-2, the image was printed on the medium PM and evaluation was performed in a manner similar to that in Experiment example 1-1 for other points excluding the foregoing point. Table 3 also describes a result of the evaluation in Experiment example 3-2, together with the result in Experiment example 3-1.

Referring to Table 1, in each of Experiment examples 1-3 to 1-6, both of the colored toner filling amount and the reproducibility of the fine lines were evaluated as "excellent" or "good". One possible reason is as follows. That is, the depressions U were selectively filled with the first transparent toner image by forming the first transparent toner image on the medium PM before forming the colored toner image. This improved flatness of the surface onto which the colored toner image was to be transferred. Another possible reason is that an influence of electric discharge due to a void inside the medium PM was able to be avoided or moderated by forming the first transparent toner image on the medium PM before forming the colored toner image. Still another possible reason is that the speed ratio VR1 at the time of the image forming operation for the first time, i.e., at the time of forming the first transparent toner image, was made greater than the speed ratio VR2 at the time of the image forming operation for the second time, i.e., at the time of forming the colored toner image and the second transparent toner image. This reduced the first transparent toner image to be formed on the protrusions P, and thereby improved the flatness of the surface onto which the colored toner image was to be transferred. Further, in Experiment examples 1-1 and 1-2, both of the colored toner filling amount and the reproducibility of the fine lines were evaluated slightly lower than those in Example embodiments 1-3 to 1-6. One possible reason for this is as follows. That is, in Experiment examples 1-1 and 1-2, the speed ratio VR1 and the speed ratio VR2 were equal to each other, or the speed ratio VR1 was smaller than the speed ratio VR2. This caused the first transparent toner image to be attached to the protrusions P in addition to the depressions U and made slightly greater the roughness, i.e., the undulations, of the surface onto which the colored toner image was to be transferred.

Referring to Table 2, in each of Experiment examples 2-1 to 2-6, both of the colored toner filling amount and the reproducibility of the fine lines were evaluated slightly lower than those in Experiment examples 1-1 to 1-6. One possible reason is as follows. That is, the second transparent toner image was not formed on the intermediate transfer belt 41 upon the image forming operation for the second time. Therefore, part of the colored toner configuring the colored toner image remained on the intermediate transfer belt 41 when the secondary transfer of the colored toner image was performed. This may have presumably influenced the colored toner filling amount and the reproducibility of the fine lines.

In contrast, in each of Experiment examples 3-1 and 3-2, the reproducibility of the fine lines, in particular, was evaluated as being poor. One possible reason is as follows. That is, the colored toner image was directly transferred onto the medium PM without forming the transparent toner image on the medium PM. Therefore, electric discharge due to the void inside the medium PM greatly influenced the reproducibility of the fine lines. Specifically, it is possible that the colored toner forming the colored toner image on the intermediate transfer belt 41 was scattered onto the medium PM before the secondary transfer was performed, which caused an outline of the fine lines to be blurred. Further, in each of Experiment examples 3-1 and 3-2, the first transparent toner image was not formed upon the image forming operation for the first time. It is possible that this decreased fixing efficiency of the colored toner image as well.

5. MODIFICATION EXAMPLES

The technology has been described above referring to the example embodiments and the experiment examples. However, the technology is not limited to the example embodiments, etc. described above, and is modifiable in various ways. For example, the foregoing example embodiments, etc. are described referring to an example in which the magnitude relationship between the speed ratio VR1 and the speed ratio VR2 may be varied by varying the conveyance speed Vt1 and the conveyance speed Vt2; however, the technology is not limited thereto. In one example embodiment of the technology, the magnitude relationship between the speed ratio VR1 and the speed ratio VR2 may be varied by varying the magnitude relationship between the linear speed Vd1 and the linear speed Vd2 of the intermediate transfer belt 41. In one example, the linear speed Vd1 may be higher than the linear speed Vd2 (Vd1>Vd2). In another example, all of the conveyance speed Vt1, the conveyance speed Vt2, the linear speed Vd1, and the linear speed Vd2 may be varied. Moreover, in one example, the same components may be applied to the first toner image supporting member and the second toner image supporting member as the foregoing intermediate transfer belt 41. In another example, components different from each other may be applied as the respective first and second toner image supporting members, as the photosensitive drum 31T and the photosensitive drum 31C.

Figure 7:
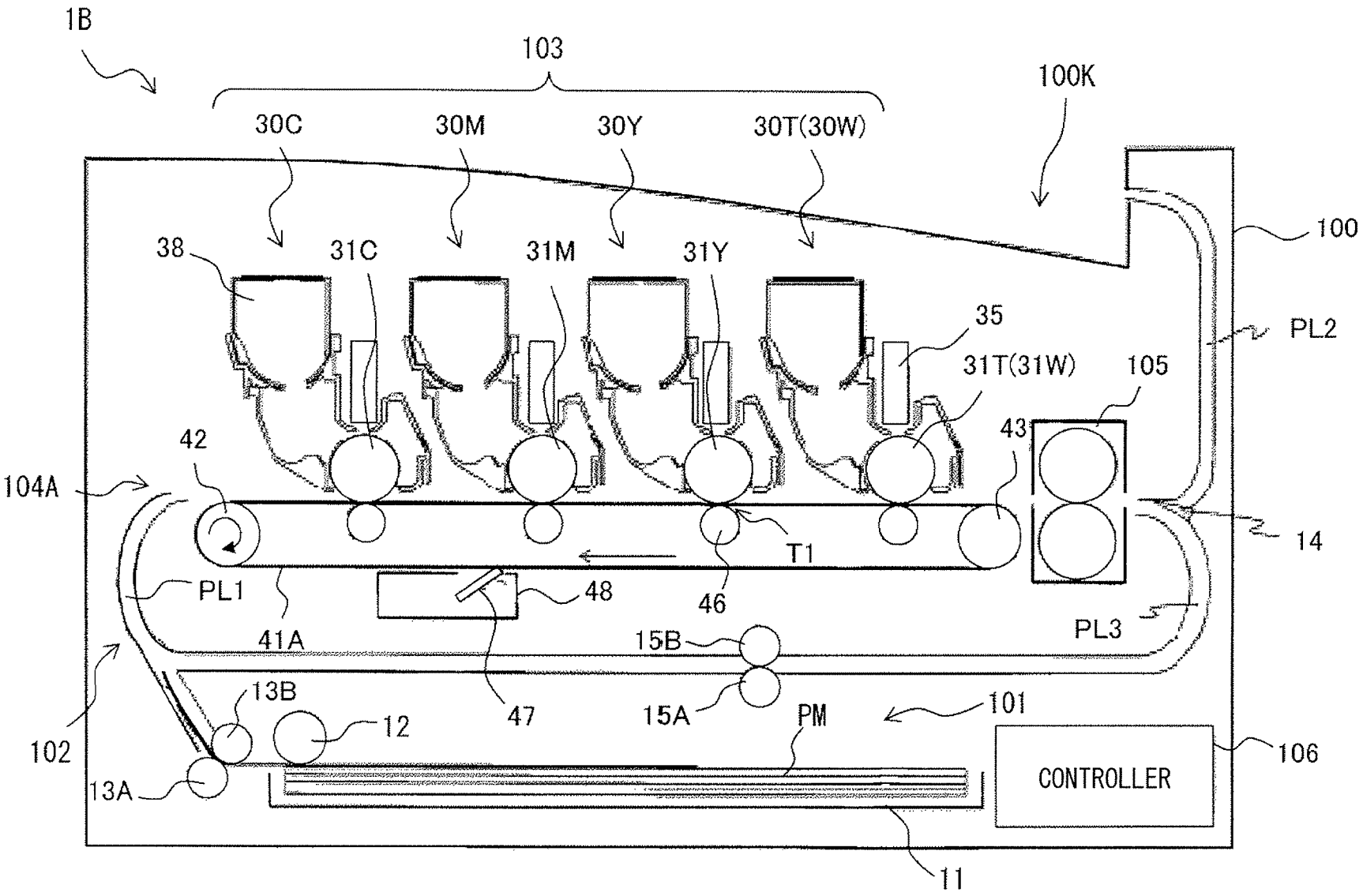
FIG. 7 is a schematic cross-sectional view of an example of a general configuration of an image forming apparatus according to a modification example of the technology.

Moreover, the foregoing example embodiments, etc. are described referring to an example of the image forming apparatus of an intermediate transfer scheme; however, the technology is not limited thereto. Alternatively, the technology is also applicable to an image forming apparatus 1B of a direct transfer scheme illustrated in FIG. 7, for example. In the image forming apparatus 1B illustrated in FIG. 7, the transfer section 104A may not include the secondary transfer section T2, and the primary transfer section T1 may perform direct transfer from the photosensitive drum 31 onto the medium PM being conveyed on a conveyance belt 41A. The primary transfer section T1 may include the photosensitive drum 31 and the primary transfer roller 46. In this case, the linear speed of the surface of the photosensitive drum 31T at the time when the image forming operation for the first time is performed may correspond to the "first linear speed" in one specific but non-limiting embodiment of the technology. The linear speed of the surface of the respective photosensitive drums 31C, 31M, and 31Y at the time when the image forming operation for the second time is performed may correspond to the "second linear speed" in one specific but non-limiting embodiment of the technology. Further, the conveyance speed of the medium PM passing through the primary transfer section T1 at the time when the image forming operation for the first time is performed may correspond to the "first conveyance speed" in one specific but non-limiting embodiment of the technology. The conveyance speed of the medium PM passing through the primary transfer section T1 at the time when the image forming operation for the second time is performed may correspond to the "second conveyance speed" in one specific but non-limiting embodiment of the technology. Further, in the image forming apparatus 1B illustrated in FIG. 7, the image forming section 103 may correspond to the "toner image supporting member" in one specific but non-limiting embodiment of the technology. The photosensitive drum 31T or 31W may correspond to the "first toner image supporting member" in one specific but non-limiting embodiment of the technology. Each of the photosensitive drums 31C, 31M, and 31Y may correspond to the "second toner image supporting member" in one specific but non-limiting embodiment of the technology. Further, the transfer section 104A including the primary transfer roller 46, the conveyance belt 41A, the driving roller 42, and the driven roller 43 may correspond to the "medium transfer section" in one specific but non-limiting embodiment of the technology. It is to be noted that the "toner image supporting member" in one specific but non-limiting embodiment of the technology is not limited to that including all of the components of the image forming section 103 illustrated in FIG. 7, and may include any component other than the components of the image forming section 103. Similarly, the "medium transfer section" in one specific but non-limiting embodiment of the technology is not limited to that including all of the components of the transfer section 104A illustrated in FIG. 7, and may include any component other than the components of the transfer section 104A.

Moreover, the series of processes that have been described above in the foregoing example embodiments, etc. may be performed by means of hardware (a circuit), or may be performed by means of software (a program). In the case where the series of processes are performed by means of the software, the software may include a group of programs directed to executing each function by a computer. Each of the programs may be provided to the foregoing computer beforehand, or may be installed on the foregoing computer from a network, a non-transitory recording medium, etc., for example.

The foregoing example embodiments, etc. have been described referring to the image forming apparatus having a printing function as an example corresponding to the "image forming apparatus" according to one specific but non-limiting embodiment of the technology. However, the function of the image forming apparatus is not limited thereto. For example, the technology is also applicable to an image forming apparatus that serves as a multi-function peripheral having functions such as a scanner function or a facsimile function in addition to the foregoing printing function.

It is possible to achieve at least the following configurations from the above-described example embodiments of the technology.

[1]

An image forming apparatus including:

a toner image supporting section that includes a first toner image supporting member and a second toner image supporting member, the first toner image supporting member supporting a first toner image at a first linear speed, the second toner image supporting member supporting a second toner image at a second linear speed; and a medium transfer section that transfers, onto a medium, the first toner image supported by the first toner image supporting member and the second toner image supported by the second toner image supporting member, or including:

a toner image supporting section that includes a toner image supporting member, the toner image supporting member supporting a first toner image at a first linear speed, and supporting a second toner image at a second linear speed; and a medium transfer section that transfers, onto a medium, the first toner image and the second toner image both supported by the toner image supporting section, in which the medium transfer section transfers the first toner image and the second toner image onto the medium to thereby cause the first toner image and the second toner image to be superimposed on each other, and the following conditional expression (1) is satisfied when the medium transfer section transfers the first toner image and the second toner image onto the medium to thereby cause the first toner image and the second toner image to be superimposed on each other, $$(Vd1-Vt1)/Vt1>(Vd2-Vt2)/Vt2 \quad (1)$$

where Vd1 is the first linear speed,

Vt1 is a first conveyance speed of the medium at time when the first toner image is transferred, Vd2 is the second linear speed, and Vt2 is a second conveyance speed of the medium at time when the second toner image is transferred.

The technology is not limited to a case where the medium transfer section transfers the first toner image and the second toner image at the same timing, but also encompasses a case where the medium transfer section transfers the first toner image at one timing and transfers the second toner image at another timing.

[2]

The image forming apparatus according to [1], in which a first difference between the first linear speed and the first conveyance speed is greater than a second difference between the second linear speed and the second conveyance speed.

[3]

The image forming apparatus according to [1] or [2], in which the first conveyance speed is higher than the second conveyance speed.

[4]

The image forming apparatus according to any one of [1] to [3], in which the first linear speed and the second linear speed are substantially equal to each other.

[5]

The image forming apparatus according to any one of [1] to [4], in which the second linear speed and the second conveyance speed are substantially equal to each other.

[6]

The image forming apparatus according to any one of [1] to [5], in which the first toner image includes a transparent image, and the second toner image includes a colored image.

[7]

The image forming apparatus according to any one of [1] to [6], further including a fixing section that performs fixing of the first toner image after the transferring of the first toner image and before the transferring of the second toner image, and performs fixing of the second toner image after the transferring of the second toner image.

[8]

An image forming apparatus including:

a toner image supporting section that performs a first image forming operation and a second image forming operation, the first image forming operation forming a first toner image at a first linear speed, the first toner image being one of a first transparent image and a white image, the second image forming operation sequentially forming a second toner image and a third toner image each at a second linear speed, after the first image forming operation, the second toner image being a second transparent image, the third toner image being a colored image; and a medium transfer section that performs a first transfer operation and a second transfer operation, the first transfer operation transferring the first toner image onto a medium conveyed at a first conveyance speed before the second image forming operation, the second transfer operation transferring the third toner image and the second toner image to thereby cause the third toner image and the second toner image to be stacked in order on the first toner image transferred onto the medium conveyed at a second conveyance speed, in which the following conditional expression (1) and the following conditional expression (2) are satisfied, $$(Vd1-Vt1)/Vt1>(Vd2-Vt2)/Vt2 \quad (1)$$

$$Vd1>Vt1 \quad (2)$$

where Vd1 is the first linear speed,

Vt1 is the first conveyance speed,

Vd2 is the second linear speed, and

Vt2 is the second conveyance speed.

The technology is not limited to a case where the medium transfer section transfers the second toner image and the third toner image at the same timing, but also encompasses a case where the medium transfer section transfers the second toner image at one timing and transfers the third toner image at another timing.

[9]

The image forming apparatus according to [8], in which the medium transfer section includes:

a primary transfer section that performs first primary transfer and second primary transfer, the first primary transfer transferring the first toner image onto an intermediate transfer member that travels at the first linear speed, the second primary transfer transferring the second toner image and the third toner image onto the intermediate transfer member that travels at the second linear speed; and a secondary transfer section that performs first secondary transfer and second secondary transfer, the first secondary transfer transferring, onto the medium that is conveyed at the first conveyance speed, the first toner image transferred onto the intermediate transfer member, the first secondary transfer transferring the first toner image transferred onto the intermediate transfer medium, while causing the intermediate transfer member to travel at the first linear speed, the second secondary transfer transferring, onto the first toner image on the medium that is conveyed at the second conveyance speed, the second toner image and the third toner image transferred onto the intermediate transfer member, the second secondary transfer transferring the second toner image and the third toner image transferred onto the intermediate transfer member, while causing the intermediate transfer member to travel at the second linear speed.

[10]

The image forming apparatus according [8] or [9], in which a first difference between the first linear speed and the first conveyance speed is greater than a second difference between the second linear speed and the second conveyance speed.

[11]

The image forming apparatus according to any one of [8] to [10], in which the first conveyance speed is higher than the second conveyance speed.

[12]

The image forming apparatus according to any one of [8] to [11], in which the first linear speed and the second linear speed are substantially equal to each other.

[13]

The image forming apparatus according to any one of [8] to [12], in which the second linear speed and the second conveyance speed are substantially equal to each other.

[14]

The image forming apparatus according to any one of [8] to [13], further including a fixing section that performs fixing of the first toner image after the transferring of the first toner image and before the transferring of the second toner image and the third toner image, the fixing section performing fixing of the second toner image and the third toner image after the transferring of the second toner image and the third toner image.

[15]

An image forming apparatus including:

a toner image supporting member including a first image forming unit and a second image forming unit, the first image forming unit forming a first toner image on a first toner image supporting member that travels at a first linear speed, the second image forming unit forming a second toner image on a second toner image supporting member that travels at a second linear speed, the first linear speed being higher than the second linear speed; and a medium transfer section that transfers the first toner image onto a medium conveyed at a first conveyance speed, the medium transfer section further transferring the second toner image onto the medium onto which the first toner image has been transferred and that is conveyed at a second conveyance speed.

[16]

An image forming apparatus including:

a toner image supporting member including a first image forming unit and a second image forming unit, the first image forming unit forming a first toner image, the second image forming unit forming a second toner image; and a medium transfer section that transfers the first toner image onto a medium conveyed at a first conveyance speed, the medium transfer section further transferring the second toner image onto the medium onto which the first toner image has been transferred and that is conveyed at a second conveyance speed, the first conveyance speed being higher than the second conveyance speed.

[17]

An image forming method including:

transferring a first toner image onto a medium, the first toner image being supported by a first toner image supporting member that travels at a first linear speed, the medium being conveyed at a first conveyance speed; and transferring a second toner image to thereby cause the second toner image to be superimposed on the first toner image transferred onto the medium, the medium being conveyed at a second conveyance speed, the second toner image being supported by a second toner image supporting member that travels at a second linear speed, in which the following conditional expression (1) is satisfied upon the transferring of the first toner image and the transferring of the second toner image, $$(Vd1-Vt1)/Vt1>(Vd2-Vt2)/Vt2 \quad (1)$$

where Vd1 is the first linear speed,

Vt1 is the first conveyance speed,

Vd2 is the second linear speed, and

Vt2 is the second conveyance speed.

[18]

An image forming method including:

transferring a first toner image onto a medium after causing the first toner image to be supported by a first toner image supporting member, the medium being conveyed at a first conveyance speed, the first toner image being one of a first transparent image and a white image;

causing a third toner image to be supported by a second toner image supporting member to thereby cause the third toner image to be superimposed on a second toner image after causing the second toner image to be supported by the second toner image supporting member, the second toner image being a second transparent image, the third toner image being a colored image; and transferring the third toner image and the second toner image to thereby cause the third toner image and the second toner image to be stacked in order on the first toner image transferred onto the medium that is conveyed at a second conveyance speed, in which the following conditional expression (1) is satisfied upon the transferring of the first toner image, the transferring of the second toner image, and the transferring of the third toner image, $$(Vd1-Vt1)/Vt1>(Vd2-Vt2)/Vt2 \quad (1)$$

where Vd1 is a first linear speed of the first toner image supporting member at time when the transferring of the first toner image is performed, Vt1 is the first conveyance speed of the medium at time when the transferring of the first toner image is performed, Vd2 is a second linear speed of the second toner image supporting member at time when the transferring of the second toner image and the transferring of the third toner image are performed, and Vt2 is the second conveyance speed of the medium at time when the transferring of the second toner image and the transferring of the third toner image are performed.

According to any of the image forming apparatus and the image forming method in one embodiment of the technology, it is possible to form an image having higher quality on the medium having a surface with large irregularities.

The engine controller 63 illustrated in FIG. 2 is implementable by circuitry that includes at least one of a field programmable gate array (FPGA), a semiconductor integrated circuit, and an application specific integrated circuit (ASIC). The FPGA is an integrated circuit (IC) designed to be configured after manufacturing in order to perform all or a part of the functions of the engine controller 63 illustrated in FIG. 2. The ASIC is an IC customized to perform all or a part of the functions of each of the engine controller 63 illustrated in FIG. 2. The semiconductor integrated circuit may be, for example, at least one processor such as a central processing unit (CPU). The processor may be configurable to read instructions from at least one machine readable tangible non-transitory medium to thereby perform all or a part of functions of the engine controller 63 illustrated in FIG. 2. The form of such a medium may include, for example, any type of magnetic medium, any type of optical medium, or any type of semiconductor memory (i.e., semiconductor circuit). The magnetic medium may be a hard disk, for example. The optical medium may be a CD or a DVD, for example. The semiconductor memory may be a volatile memory or a non-volatile memory, for example. The volatile memory may include a DRAM or a SRAM, for example. The nonvolatile memory may include a ROM or a NVRAM, for example.

Although the technology has been described in terms of exemplary embodiments, it is not limited thereto. It should be appreciated that variations may be made in the described embodiments by persons skilled in the art without departing from the scope of the invention as defined by the following claims. The limitations in the claims are to be interpreted broadly based on the language employed in the claims and not limited to examples described in this specification or during the prosecution of the application, and the examples are to be construed as non-exclusive.

What is claimed is:

1. An image forming apparatus comprising:

a toner image supporting section that includes a first toner image supporting member and a second toner image supporting member, the first toner image supporting member supporting a first toner image at a first linear speed, the second toner image supporting member supporting a second toner image at a second linear speed; and a medium transfer section that transfers, onto a medium, the first toner image supported by the first toner image supporting member and the second toner image supported by the second toner image supporting member, or comprising:

a toner image supporting section that includes a toner image supporting member, the toner image supporting member supporting a first toner image at a first linear speed, and supporting a second toner image at a second linear speed; and a medium transfer section that transfers, onto a medium, the first toner image and the second toner image both supported by the toner image supporting section, wherein the medium transfer section transfers the first toner image and the second toner image onto the medium to thereby cause the first toner image and the second toner image to be superimposed on each other, and the following conditional expression (1) is satisfied when the medium transfer section transfers the first toner image and the second toner image onto the medium to thereby cause the first toner image and the second toner image to be superimposed on each other, $$(Vd1-Vt1)/Vt1>(Vd2-Vt2)/Vt2 \quad (1)$$

where Vd1 is the first linear speed,

Vt1 is a first conveyance speed of the medium at time when the first toner image is transferred, Vd2 is the second linear speed, and Vt2 is a second conveyance speed of the medium at time when the second toner image is transferred.

2. The image forming apparatus according to claim 1, wherein a first difference between the first linear speed and the first conveyance speed is greater than a second difference between the second linear speed and the second conveyance speed.

3. The image forming apparatus according to claim 1, wherein the first conveyance speed is lower than the second conveyance speed.

4. The image forming apparatus according to claim 1, wherein the first linear speed and the second linear speed are substantially equal to each other.

5. The image forming apparatus according to claim 1, wherein the second linear speed and the second conveyance speed are substantially equal to each other.

6. The image forming apparatus according to claim 1, wherein the first toner image comprises a transparent image, and the second toner image comprises a colored image.

7. The image forming apparatus according to claim 1, further comprising a fixing section that performs fixing of the first toner image after the transferring of the first toner image and before the transferring of the second toner image, and performs fixing of the second toner image after the transferring of the second toner image.

8. An image forming apparatus comprising:

a toner image supporting section that performs a first image forming operation and a second image forming operation, the first image forming operation forming a first toner image at a first linear speed, the first toner image being one of a first transparent image and a white image, the second image forming operation sequentially forming a second toner image and a third toner image each at a second linear speed, after the first image forming operation, the second toner image being a second transparent image, the third toner image being a colored image; and a medium transfer section that performs a first transfer operation and a second transfer operation, the first transfer operation transferring the first toner image onto a medium conveyed at a first conveyance speed before the second image forming operation, the second transfer operation transferring the third toner image and the second toner image to thereby cause the third toner image and the second toner image to be stacked in order on the first toner image transferred onto the medium conveyed at a second conveyance speed, wherein the following conditional expression (1) and the following conditional expression (2) are satisfied, $$(Vd1-Vt1)/Vt1>(Vd2-Vt2)/Vt2 \quad (1)$$

$$Vd1>Vt1 \quad (2)$$

where Vd1 is the first linear speed,

Vt1 is the first conveyance speed,

Vd2 is the second linear speed, and

Vt2 is the second conveyance speed.

9. The image forming apparatus according to claim 8, wherein the medium transfer section includes:

a primary transfer section that performs first primary transfer and second primary transfer, the first primary transfer transferring the first toner image onto an intermediate transfer member that travels at the first linear speed, the second primary transfer transferring the second toner image and the third toner image onto the intermediate transfer member that travels at the second linear speed; and a secondary transfer section that performs first secondary transfer and second secondary transfer, the first secondary transfer transferring, onto the medium that is conveyed at the first conveyance speed, the first toner image transferred onto the intermediate transfer member, the first secondary transfer transferring the first toner image transferred onto the intermediate transfer medium, while causing the intermediate transfer member to travel at the first linear speed, the second secondary transfer transferring, onto the first toner image on the medium that is conveyed at the second conveyance speed, the second toner image and the third toner image transferred onto the intermediate transfer member, the second secondary transfer transferring the second toner image and the third toner image transferred onto the intermediate transfer member, while causing the intermediate transfer member to travel at the second linear speed.

10. The image forming apparatus according to claim 8, wherein a first difference between the first linear speed and the first conveyance speed is greater than a second difference between the second linear speed and the second conveyance speed.

11. The image forming apparatus according to claim 8, wherein the first conveyance speed is lower than the second conveyance speed.

12. The image forming apparatus according to claim 8, wherein the first linear speed and the second linear speed are substantially equal to each other.

13. The image forming apparatus according to claim 8, wherein the second linear speed and the second conveyance speed are substantially equal to each other.

14. The image forming apparatus according to claim 8, further comprising a fixing section that performs fixing of the first toner image after the transferring of the first toner image and before the transferring of the second toner image and the third toner image, the fixing section performing fixing of the second toner image and the third toner image after the transferring of the second toner image and the third toner image.

* * * * *